US008653422B2

(12) United States Patent
Shimura et al.

(10) Patent No.: US 8,653,422 B2
(45) Date of Patent: Feb. 18, 2014

(54) HEATER, IMAGE HEATING DEVICE WITH THE HEATER AND IMAGE FORMING APPARATUS THEREIN

(75) Inventors: Yasuhiro Shimura, Yokohama (JP); Koji Nihonyanagi, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 95 days.

(21) Appl. No.: 13/384,405

(22) PCT Filed: Sep. 3, 2010

(86) PCT No.: PCT/JP2010/065573

§ 371 (c)(1),
(2), (4) Date: Jan. 17, 2012

(87) PCT Pub. No.: WO2011/030843

PCT Pub. Date: Mar. 17, 2011

(65) Prior Publication Data

US 2012/0121306 A1 May 17, 2012

(30) Foreign Application Priority Data

Sep. 11, 2009 (JP) ..... 2009-210706
Dec. 21, 2009 (JP) ..... 2009-289722

(51) Int. Cl.
*G03G 15/20* (2006.01)
*H05B 3/03* (2006.01)
*H05B 3/10* (2006.01)

(52) U.S. Cl.
USPC ..... 219/216; 219/539; 219/541; 399/329

(58) Field of Classification Search
None
See application file for complete search history.

(56) References Cited

U.S. PATENT DOCUMENTS 5,640,231 A * 6/1997 Mitsui et al. ..... 399/335
6,096,995 A * 8/2000 Toyota et al. ..... 219/216
6,456,819 B1 * 9/2002 Abe et al. ..... 399/329
7,155,136 B2 12/2006 Nihonyanagi et al.
7,190,914 B2 3/2007 Nihonyanagi et al.
7,215,899 B2 5/2007 Kimizuka et al.

(Continued)

FOREIGN PATENT DOCUMENTS

EP 0 586 063 A2 3/1994
JP 2004-354416 A 12/2004

(Continued)

OTHER PUBLICATIONS

Office Action issued in European Patent Application No. Application No. 10757290.1, dated Jan. 18, 2013.

(Continued)

*Primary Examiner* — Joseph M Pelham
(74) *Attorney, Agent, or Firm* — Fitzpatrick, Cella, Harper & Scinto

(57) ABSTRACT

The heater is capable of improving heat generation uniformity in a sheet feeding area while suppressing the temperature rise of a non-sheet feeding portion. Each of heat generation lines includes a plurality of heat blocks in which a plurality of heat generating resistors are electrically connected in parallel between two conductive members. The heat generation lines are arranged in a lateral direction of the substrate, and the heat blocks are arranged so that the end of the heat block in the heat generation line of a first row does not overlap with the end of the heat block in the heat generation line of a second row in a longitudinal direction of a heater.

11 Claims, 17 Drawing Sheets

(56) References Cited

U.S. PATENT DOCUMENTS

| | | | | |
|---|---|---|---|---|
| 7,251,447 | B2 | 7/2007 | Kanamori et al. | |
| 7,518,089 | B2 | 4/2009 | Hashiguchi et al. | |
| 7,630,662 | B2 | 12/2009 | Namiki et al. | |
| 2003/0196999 | A1 | 10/2003 | Kato et al. | |
| 2009/0230114 | A1* | 9/2009 | Taniguchi et al. | 219/216 |
| 2010/0310267 | A1 | 12/2010 | Shimura et al. | |
| 2011/0150545 | A1 | 6/2011 | Nihonyanagi et al. | |
| 2011/0280596 | A1 | 11/2011 | Shimura | |
| 2011/0280597 | A1 | 11/2011 | Shimura et al. | |
| 2012/0000897 | A1 | 1/2012 | Shimura | |
| 2012/0121306 | A1* | 5/2012 | Shimura et al. | 399/329 |
| 2012/0201581 | A1* | 8/2012 | Shimura | 399/329 |
| 2012/0201582 | A1* | 8/2012 | Shimura et al. | 399/329 |

FOREIGN PATENT DOCUMENTS

| | | | |
|---|---|---|---|
| JP | 2005-209493 | A | 8/2005 |
| JP | 2007-242273 | A | 9/2007 |
| JP | 2009-199862 | A | 9/2009 |

OTHER PUBLICATIONS

Notification Concerning Transmittal of International Preliminary Report on Patentability, International Preliminary Report on Patentability, and Written Opinion of the International Searching Authority dated Mar. 22, 2012, in counterpart International Application No. PCT/2010/065573.

International Search Report and Written Opinion of the International Searching Authority dated Dec. 2, 2010, in International Application No. PCT/JP2010/065573.

Korean Office Action dated Aug. 19, 2013, in counterpart Korean Office Action No. 10-2012-7008628.

English translation of Korean Office Action dated Aug. 19, 2013, issued in Korean Application No. 10-2012-7008628.

* cited by examiner

| | HEAT GENERATION PATTERN | | | | | | | | UNIT |
|---|---|---|---|---|---|---|---|---|---|
| | 1 | 2 | 3 | 4 | 5 | 6 | 7 | 8 | |
| a: LENGTH | 2.09 | 2.09 | 2.09 | 2.09 | 2.09 | 2.09 | 2.09 | 2.09 | mm |
| b: WIDTH | 0.70 | 0.76 | 0.80 | 0.83 | 0.83 | 0.80 | 0.76 | 0.70 | mm |
| c: SPACE | 1.35 | 1.35 | 1.35 | 1.35 | 1.35 | 1.35 | 1.35 | 1.35 | mm |
| RESISTANCE | 2.23 | 2.06 | 1.95 | 1.89 | 1.89 | 1.95 | 2.06 | 2.23 | Ω |

HEATER, IMAGE HEATING DEVICE WITH THE HEATER AND IMAGE FORMING APPARATUS THEREIN

TECHNICAL FIELD

The present invention relates to a heater which is suitably utilized in a heating fixing device provided in an image forming apparatus such as an electrophotographic copier or an electrophotographic printer, an image heating device on which this heater is mounted, and an image forming apparatus.

BACKGROUND ART

As a fixing device provided in a photocopier or a printer, there is a type of the fixing device including an endless belt, a ceramic heater which comes into contact with the inner surface of the endless belt, and a pressure roller which forms a fixing nip portion together with the ceramic heater via the endless belt. When small-size sheets are continuously printed by an image forming apparatus provided with this fixing device, a phenomenon (the temperature rise of a non-sheet feeding portion) in which the temperature gradually rises in an area through which no sheet passes in the longitudinal direction of the fixing nip portion occurs. If the temperature of the non-sheet feeding portion excessively rises, parts in the device are damaged, or toner offsets at a high temperature causes in the area corresponding to the non-sheet feeding portion of the small-size sheets when a large-size sheets are printed in a state where the temperature rises at the non-sheet feeding portion.

As one of means to suppress the temperature rise of the non-sheet feeding portion, it is considered that a heat generating resistor on a ceramic substrate is made of a material having negative resistance temperature characteristics. Even if the temperature of the non-sheet feeding portion rises, the resistance value of the heat generating resistor of the non-sheet feeding portion lowers. Therefore, it is considered that even when a current flows through the heat generating resistor of the non-sheet feeding portion, the heat generation of the non-sheet feeding portion is suppressed. In the negative resistance temperature characteristics, when the temperature rises, the resistance lowers. Hereinafter, the characteristics will be referred to as a negative temperature coefficient (NTC). Conversely, it is suggested that the heat generating resistor is made of a material having positive resistance temperature characteristics. It is considered that when the temperature of the non-sheet feeding portion rises, the resistance value of the heat generating resistor of the non-sheet feeding portion rises, and the current flowing through the heat generating resistor of the non-sheet feeding portion is suppressed to inhibit the heat generation of the non-sheet feeding portion. In the positive resistance temperature characteristics, when the temperature rises, the resistance rises. Hereinafter, the characteristics will be referred to as a positive temperature coefficient (PTC).

However, the material having the NTC usually has a very high volume resistance. It is very difficult to set the total resistance of the heat generating resistors formed in one heater to a range usable with a commercial power supply. Conversely, the material having the PTC has a very low volume resistance. In the same manner as in the material having the NTC, it is very difficult to set the total resistance of the heat generating resistors in the heater to the range usable with the commercial power supply.

To solve such a problem, the heat generating resistors of the PTC formed on the ceramic substrate are divided by a plurality of heat blocks in the longitudinal direction of the heater. In each of the heat blocks, two conductive members are arranged at both ends of the block in the lateral direction of the substrate so that the current flows through the block in the lateral direction of the heater (the conveyance direction of a recording sheet). Furthermore, Japanese Patent Application Laid-Open No. 2005-209493 discloses the plurality of heat blocks electrically connected in series. According to such a constitution, even when the heat generating resistor of the PTC is used, the total resistance of the heater can easily be set to the range usable with the commercial power supply. Moreover, this document also discloses that a plurality of heat generating resistors is electrically connected in parallel between two conductive members to form the heat block.

SUMMARY OF INVENTION

Technical Problem

Because, however, the resistance value of each conductive member is not zero, and owing to the influence of a voltage drop occurring in the conductive member, voltages applied to heat generating resistors in the center of one heat block are smaller than those applied to heat generating resistors at both ends thereof. The heat generation amount of each heat generating resistor is proportional to the square of the applied voltage. Therefore, the heat generation amount of the center of the heat block is different from that of each end of the heat block. In this way, when heat generation unevenness occurs in the heat block, the heat generation distribution unevenness in the longitudinal direction of a heater also increases.

Solution to Problem

In order to solve the above problem, according to the present invention, the purpose of the present invention is to provide a heater including a substrate, first and second conductive members provided on the substrate, and a heat generating resistor interconnected between the first conductive member and the second conductive member, the first conductive member being provided along the longitudinal direction of the substrate, the second conductive member being provided along the longitudinal direction at a position different from that of the first conductive member in the lateral direction of the substrate, a plurality of heat generating resistors being electrically connected in parallel between the first conductive member and the second conductive member, a plurality of heat blocks including a plurality of heat generating resistors electrically connected in parallel being arranged along the longitudinal direction, the plurality of heat blocks being electrically connected in series, wherein rows including the plurality of heat blocks electrically connected in series are arranged on the substrate in the lateral direction, and the positions of the heat blocks of the first row are shifted from those of the heat blocks of the second row in the longitudinal direction so that the end of the heat in the first row does not overlap with the end of the heat block in the second row in the longitudinal direction, and an image forming apparatus including the heater.

Moreover, another purpose of the present invention is to provide an image forming apparatus including an image forming part which forms an unfixed image on a recording material, and a fixing part including an endless belt, a heater which comes in contact with the inner surface of the endless belt, and a nip portion forming member which forms a nip portion together with the heater via the endless belt, configured to heat and fix the unfixed image on the recording material while pinching and conveying the recording material having the unfixed image at the nip portion, the heater including a substrate, a first conductive member provided on the substrate along the longitudinal direction of the substrate, a second conductive member provided along the longitudinal direction at a position different from that of the first conductive member on the substrate in the lateral direction of the substrate, and a plurality of heat generating resistors having positive resistance temperature characteristics and electrically connected in parallel between the first conductive member and the second conductive member, the heater having a heat block structure in which a portion most distant from a recording material conveyance reference in the longitudinal direction of the substrate in an area provided with the heat generating resistors includes the plurality of heat generating resistors connected in parallel, wherein the plurality of heat generating resistors are arranged with an angle with respect to the longitudinal direction and the recording material conveyance direction so as to obtain such a positional relation that the shortest current path of each of the heat generating resistors overlaps with, in the longitudinal direction, the shortest current path of the heat generating resistors provided adjacent to each other in the longitudinal direction, and the heat generating resistors are arranged so that when the recording material having at least one specific size of sizes smaller than the largest standard recording material size dealt by the apparatus passes through the nip portion, the side of the edge of the recording material in the longitudinal direction does not pass through the areas provided with the heat generating resistors at both ends of the heat block provided in an endmost portion.

Advantageous Effects OF Invention

According to the present invention, a heat generation distribution unevenness in the longitudinal direction of a heater can be suppressed.

Further features of the present invention will become apparent from the following description of exemplary embodiments with reference to the attached drawings.

DESCRIPTION OF EMBODIMENTS

Figure 1:
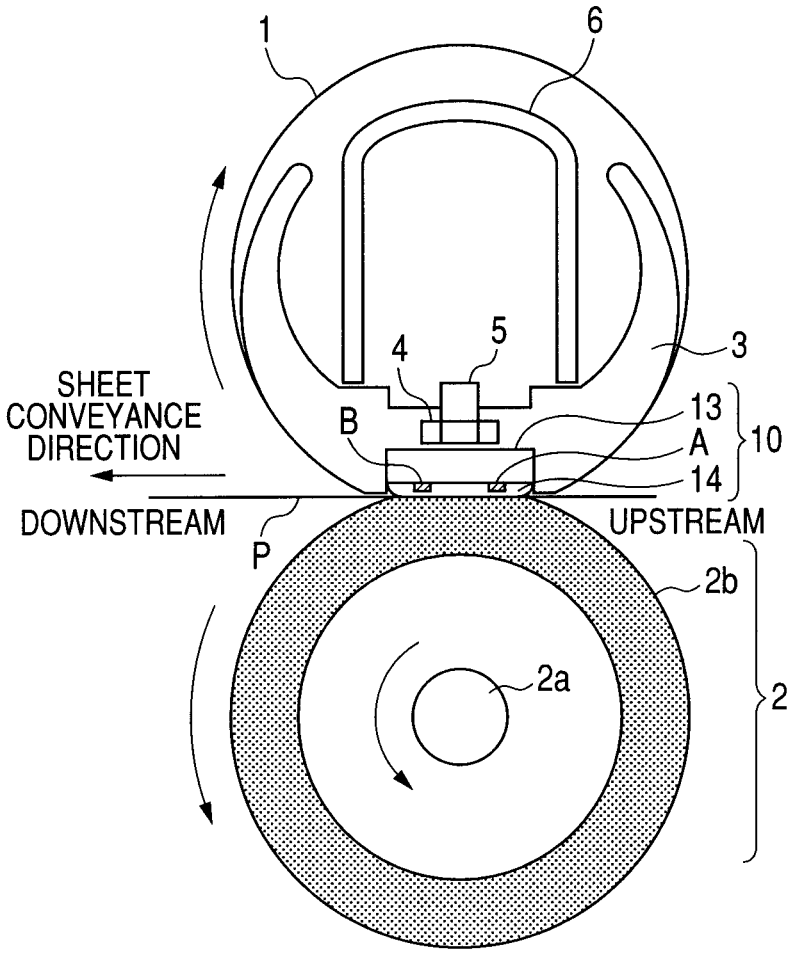
FIG. 1 is a sectional view of an image heating device of the present invention.

FIG. 1 is a sectional view of a fixing device as one example of an image heating device. The fixing device includes a tubular film (an endless belt) 1, a heater 10 which comes in contact with the inner surface of the film 1, and a pressure roller (a nip portion forming member) 2 which forms a fixing nip portion N together with the heater 10 via the film 1. The material of a base layer of the film is a heat-resistant resin such as polyimide or a metal such as stainless steel. The pressure roller 2 includes a core metal 2*a* of a material such as iron or aluminum and an elastic layer 2*b* of a material such as silicone rubber. The heater 10 is held by a holding member 3 made of the heat-resistant resin. The holding member 3 also has a guide function of guiding the rotation of the film 1. The pressure roller 2 receives a power from a motor (not shown) to rotate in an arrow direction. The pressure roller 2 rotates, and accordingly, the film 1 rotates.

The heater 10 includes a heater substrate 13 made of a ceramic material, a heat generation line A (a first row) and a heat generation line B (a second row) formed on the substrate 13, and an insulating surface protective layer 14 (glass in the present example) which covers the heat generation lines A and B. A temperature detection element 4 such as a thermistor contacts a sheet feeding area of sheets having a minimum usable size set in a printer on the back surface side of the heater substrate 13. The power to be supplied from a commercial alternate current power supply to the heat generation lines is controlled in accordance with the detected temperature of the temperature detection element 4. A recording material (a sheet) P having an unfixed toner image is heated and fixed, while nipped and conveyed by the fixing nip portion N. A safety element 5 such as a thermo switch also contacts the back surface side of the heater substrate 13, and the safety element operates to block a power supply line leading to the heat generation lines, when the temperature of the heater abnormally rises. The safety element 5 contacts the sheet feeding area of the sheets having the minimum size in the same manner as in the temperature detection element 4. A stay 6 made of a metal is configured to add the pressure of a spring (not shown) to the holding member 3.

EXAMPLE 1

Figure 2A:
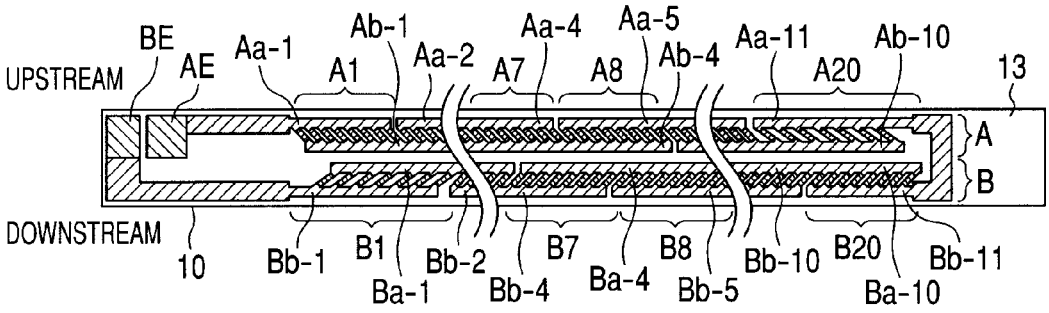
FIGS. 2A, 2B and 2C are heater constitution diagrams of Example 1.
Figure 2B:
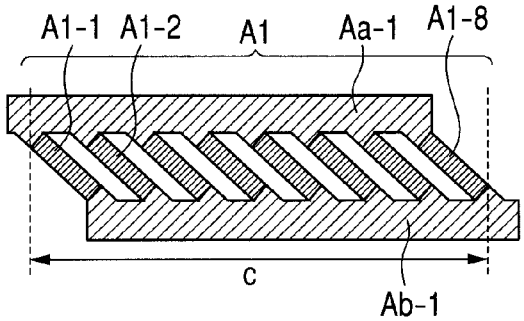
Figure 2C:
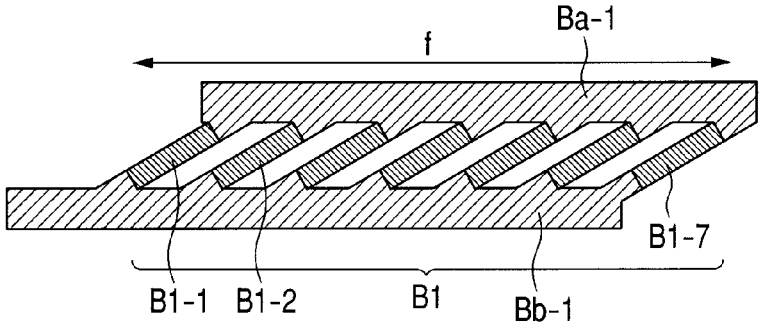

FIGS. 2A to 2C illustrate diagrams for explaining a heater structure. FIG. 2A is a front view of the heater, FIG. 2B is an enlarged view showing one heat block Al in the heat generation line A, and FIG. 2C is an enlarged view showing one heat block B1 in the heat generation line B. It is to be noted that each of the heat block A1 in the heat generation line A and the heat block B1 in the heat generation line B includes heat generating resistors each having a PTC.

The heat generation line A (the first row) includes 20 heat blocks A1 to A20, and the heat blocks A1 to A20 are connected in series. The heat generation line B (the second row) includes 20 heat blocks B1 to B20, and the heat blocks B1 to B20 are also connected in series. Moreover, the heat generation lines A and B are electrically connected in series. A power is supplied to the heat generation lines A and B from electrodes AE and BE connected to power supplying connectors.

The heat generation line A has a conductive pattern Aa provided along the substrate longitudinal direction (a first conductive member of the heat generation line A) and a conductive pattern Ab (a second conductive member of the heat generation line A) provided in the substrate longitudinal direction at a position different from that of the conductive pattern Aa in the lateral direction of the substrate. The conductive pattern Aa is divided into eleven patterns (Aa-1 to Aa-11) in the substrate longitudinal direction. The conductive pattern Ab is divided into ten patterns (Aa-1 to Aa-10) in the substrate longitudinal direction. As shown in FIG. 2B, a plurality of (eight in the present example) heat generating resistors (A1-1 to A1-8) are electrically connected in parallel between the conductive pattern Aa-1 as a part of the conductive pattern Aa and the conductive pattern Ab-1 as a part of the conductive pattern Ab, to form the heat block A1. Moreover, eight heat generating resistors (A2-1 to A2-8) are electrically connected in parallel between the conductive pattern Ab-1 and the conductive pattern Aa-2, to form the heat block A2 (in FIGS. 2A to 2C, a part of the block A2 is omitted, and hence symbols are omitted). In the heat generation line A, there are provided 19 heat blocks (A1 to A19) in total, each having a constitution similar to the heat block A1. However, the only heat block A20 in the heat generation line A is different from the other heat blocks in the length of the heat block and the number of the heat generating resistors.

The heat generation line B also has a conductive pattern Ba provided along the longitudinal direction of the substrate (a first conductive member of the heat generation line A) and a conductive pattern Bb (a second conductive member of the heat generation line B) provided along the longitudinal direction of the substrate at a position different from that of the conductive pattern Ba in the lateral direction of the substrate. The constitution of each heat block in the heat generation line B is also similar to that in the heat generation line A, and the constitution of each of 19 heat blocks (B2 to B20) in the heat generation line B is the same as that of each of the heat blocks (A1 to A19) in the heat generation line A. Moreover, the only heat block B1 in the heat generation line B is different from the other heat blocks in the length of the heat block and the number of the heat generating resistors.

Meanwhile, as described above, it has been found that the resistance value of each conductive member is not zero, and owing to the influence of a voltage drop in the conductive member, voltages applied to heat generating resistors in the center of one heat block are smaller than those applied to heat generating resistors at both ends thereof. The heat generation amount of each heat generating resistor is proportional to the square of the applied voltage. Therefore, the heat generation amount of the center of the one heat block is different from that of each end thereof. Specifically, the heat generation amounts at both the ends of the heat block are largest, and the heat generation amount in the center thereof decreases. In this way, when heat generation unevenness occurs in the heat block, the heat generation distribution unevenness in the longitudinal direction of the heater also increases.

Consequently, as shown in FIG. 2A, the heater of the present example includes a plurality of rows each including a plurality of heat blocks electrically connected in series (the heat generation lines A and B) in the lateral direction of the substrate. Moreover, the positions of the heat blocks in the heat generation line A (the first row) are shifted from those of the heat blocks in the heat generation line B (the second row) in the longitudinal direction of the substrate so that the end of the heat block in the heat generation line A (the first row) does not overlap with the end of the heat block in the heat generation line B (the second row) in the longitudinal direction of the substrate. A position where a heat generation amount in the heat generation line A is large and a position where large heat generation amount in the heat generation line B do not overlap with each other in the substrate longitudinal direction. Alternatively, positions where a heat generation amount in the heat generation lines is small do not overlap with each other in the substrate longitudinal direction. In consequence, the heat generation distribution unevenness in the heater longitudinal direction can be decreased.

Figure 3A:
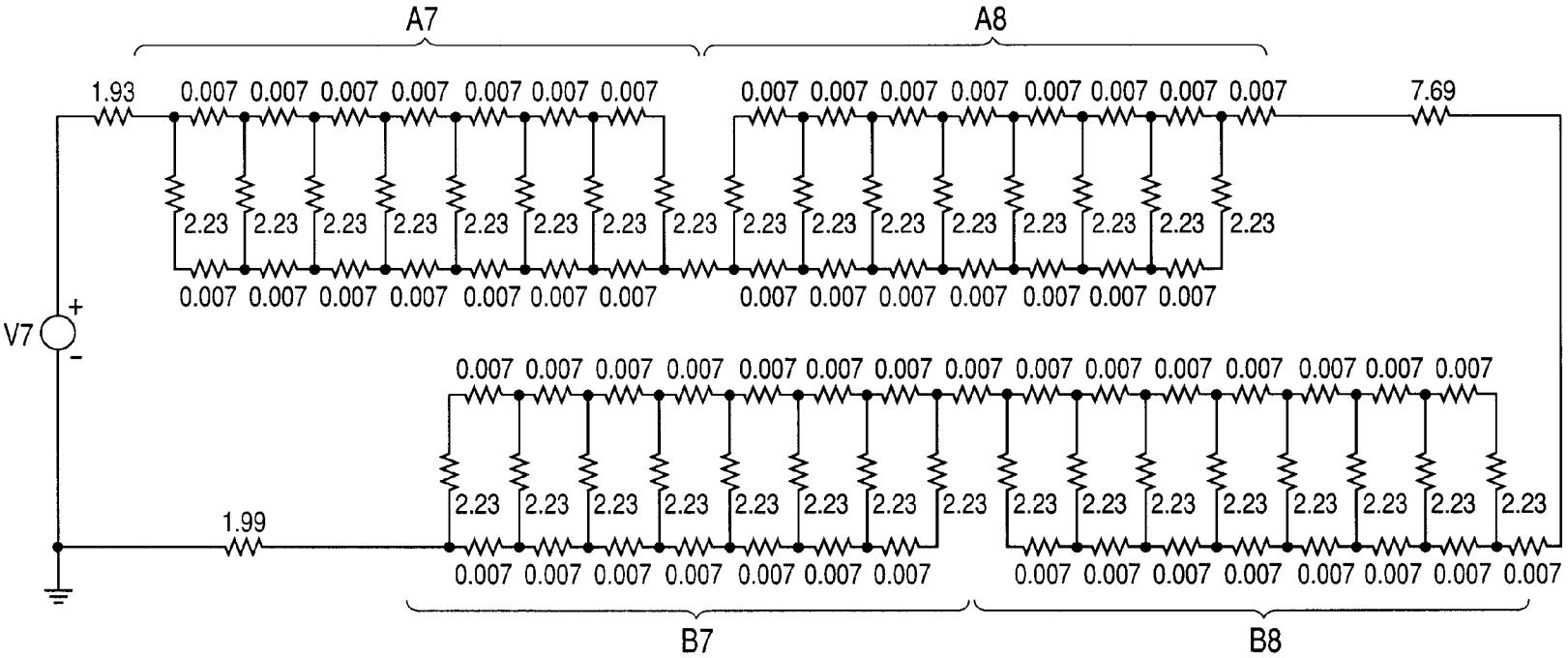
FIGS. 3A, 3B and 3C are explanatory views of the heat generation distribution of the heater of Example 1.
Figure 3B:
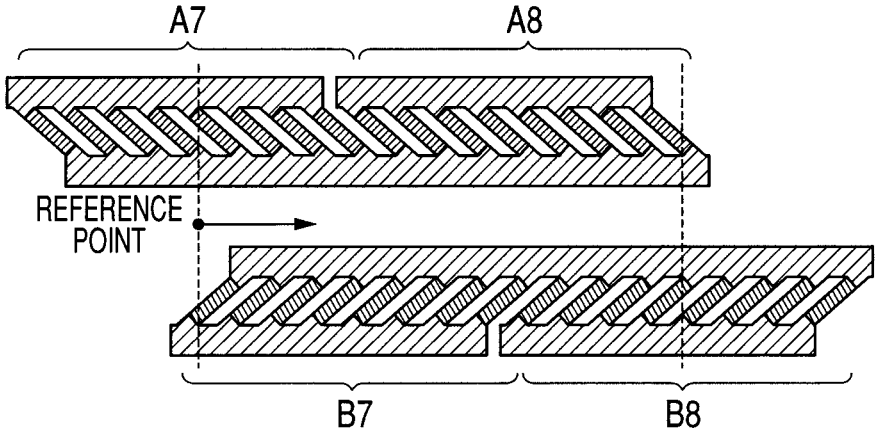
Figure 3C:
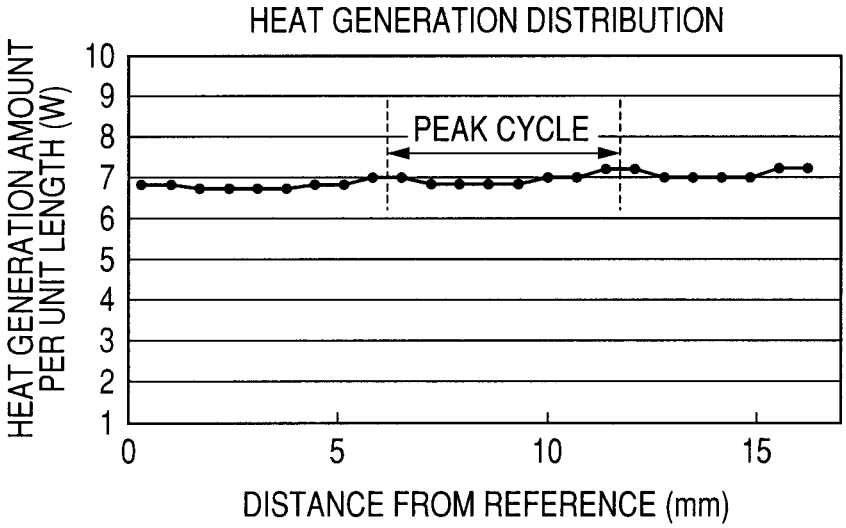

There will be described a heat generation distribution unevenness suppression effect in a case where the heat blocks of the heat generation line A are shifted from the heat blocks of the heat generation line B in the substrate longitudinal direction, with reference to FIGS. 3A to 3C. FIG. 3A is a simulation circuit diagram of the heater, FIG. 3B is a diagram showing a positional relation between the heat blocks of the heat generation line A and the heat blocks of the heat generation line B, and FIG. 3C is a heat generation distribution diagram of the heater. FIG. 3A illustrates the simulation circuit diagram prepared by simplifying conditions. It is to be noted that in FIG. 3A, the total resistance value of the heat generating resistors of the heater 10 is set to about 12.85Ω, the sheet resistance value of each conductive pattern is set to 0.005Ω/□, and the sheet resistance value of a heat resistive paste is set to 0.85Ω/□. The resistance values are measured at 20° C. Moreover, the resistance temperature coefficient of the heat resistive paste is 1000 ppm. In FIG. 3A, the resistance values of the heat blocks other than the heat blocks A7, A8, B7 and B8 are shown as a synthesized resistance value. In the present example, the heat blocks are shifted and arranged so that both the ends of the heat block B7 overlap with the centers of the heat blocks A7 and A8 in the substrate longitudinal direction.

As shown in FIG. 3A, the resistance value of the conductive pattern connecting the adjacent heat generating resistors to each other in one heat block is 0.007Ω. Therefore, a current flowing through the heat generating resistors positioned at both the ends of the heat block increases, and the current does not easily flow through the heat generating resistors positioned in the center thereof. To solve this problem, as shown in FIG. 3B, the heat blocks of the heat generation line A are shifted from the heat blocks of the heat generation line B in the substrate longitudinal direction. As shown in the temperature distribution of FIG. 3C, it is seen that when the heat blocks are shifted, the upper and lower limit values of the heat generation distribution fall in a range of about ±3%, and a peak cycle is the half of the heat block length.

Figure 4A:
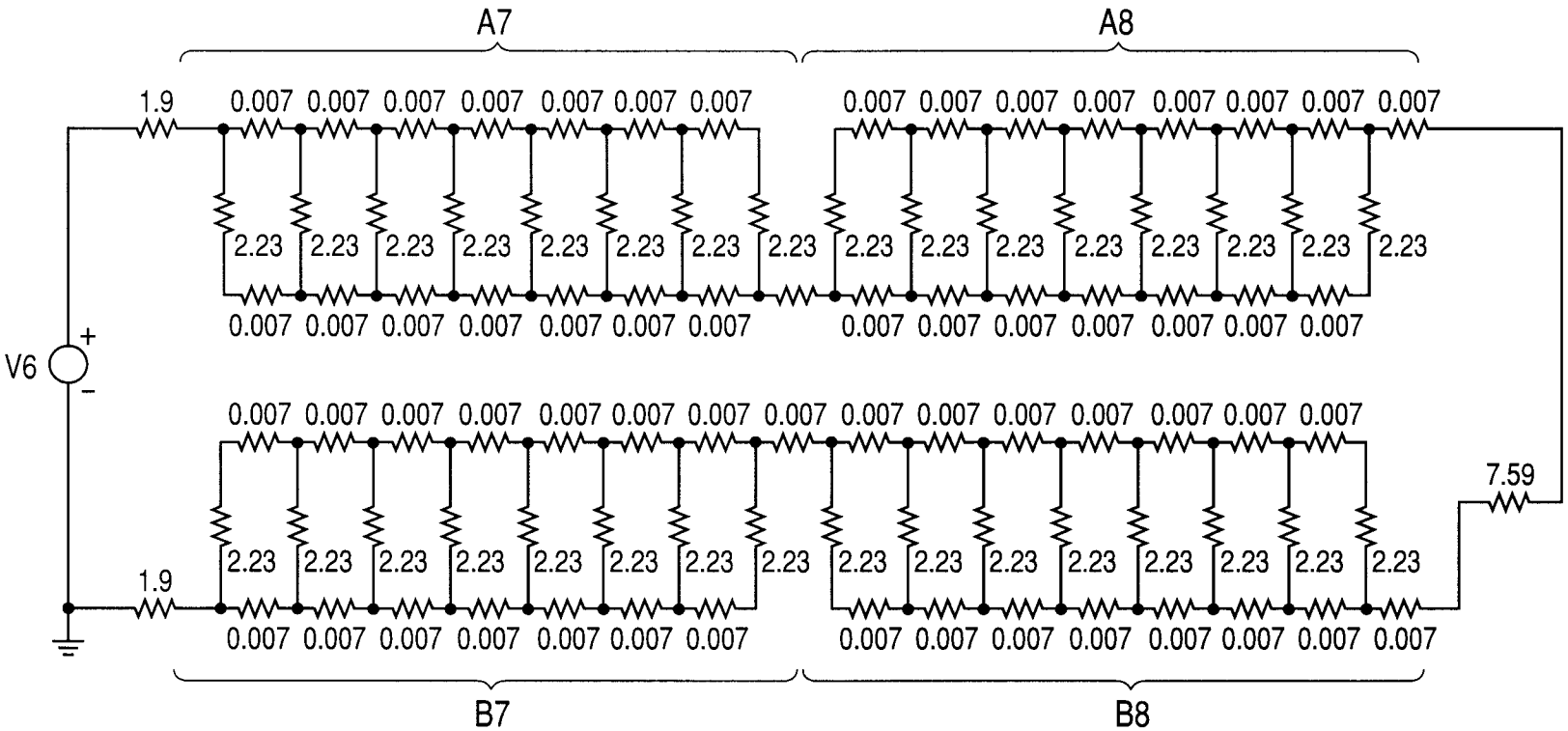
FIGS. 4A, 4B and 4C are explanatory views of the heat generation distribution of a heater of a comparative example.
Figure 4B:
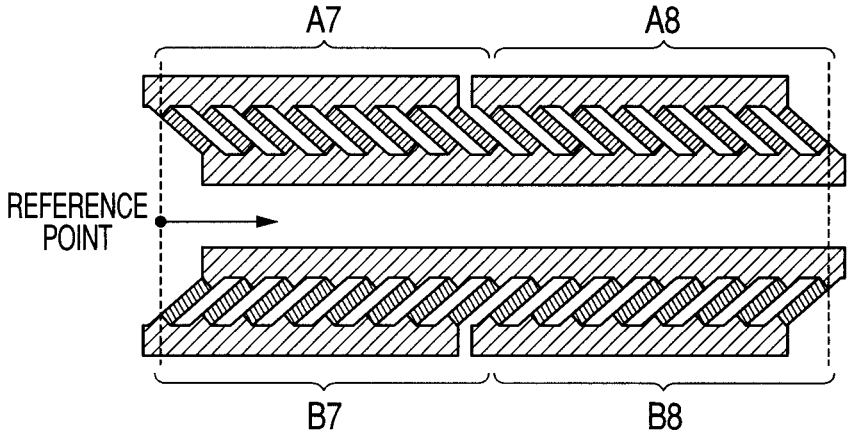
Figure 4C:
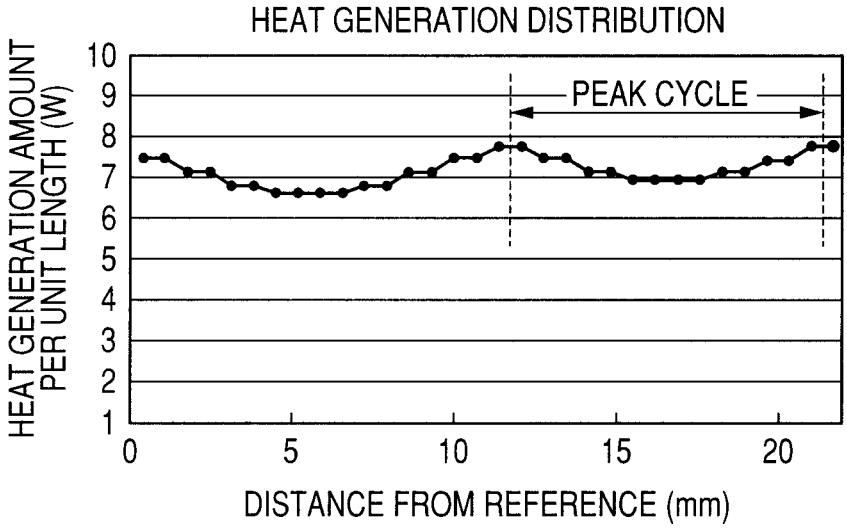

On the other hand, FIGS. 4A to 4C illustrate a comparative example in which heat blocks of a heat generation line A and heat blocks of a heat generation line B are not shifted in a substrate longitudinal direction, but are completely superimposed on each other. It is seen that the upper and lower limit values of the heat generation distribution fall in a range of about ±8%, and a peak cycle is equal to a heat block length. When the simulation result of FIGS. 3A to 3C is compared with that of FIGS. 4A to 4C, the fluctuation of the upper and lower limit values of the heat generation distribution of the heater of the present example is the half of that of a heater of the comparative example, and the peak cycle of the heat generation distribution is ½. Therefore, it is seen that a heat generation distribution unevenness is suppressed in the heater of the present example as compared with the heater of the comparative example. The above heat generation unevenness becomes remarkable, as the resistance component of a conductive pattern increases with respect to the resistance component of the heat generating resistor or as the number of the heat generating resistors in the heat block increases. For example, when the sheet resistance value of the conductive pattern of the heater increases or when the line width of the conductive pattern decreases, the heat generation unevenness remarkably occurs.

Thus, rows including a plurality of heat blocks electrically connected in series are arranged on the substrate in the lateral direction thereof, and the positions of the heat blocks in the heat generation line A (the first row) are shifted from those of the heat blocks in the heat generation line B (the second row) in the substrate longitudinal direction. In the constitution, the heat generation distribution unevenness can be suppressed.

Moreover, the shape of one heat generating resistor is not limited to a rectangular shape shown in FIGS. 2A to 2C, but the shape is especially preferably rectangular. When the rectangular shape is used, the current can easily flow through the whole heat generating resistor. For example, when the heat generating resistor has a parallelogram shape, the shortest path through which the current easily flows is not provided in the whole heat generating resistor but is provided in a part of the member, and a large amount of current is concentrated on this shortest path. Therefore, deviation occurs in the distribution of the current flowing through the heat generating resistor, and the heat generation distribution unevenness suppression effect deteriorates. However, when the shape is changed to the rectangular shape, this phenomenon can be suppressed. Furthermore, the adjacent heat generating resistors are arranged so as to partially overlap with each other in the substrate longitudinal direction. This can avoid the occurrence of an area where any heat is not generated in the substrate longitudinal direction. In consequence, the unevenness of the heat generation distribution can further be minimized.

Next, there will be described the heat blocks (A20 and B1) having a constitution different from that of the other heat blocks in the heat generation lines A and B in the heater shown in FIGS. 2A to 2C. As described above, when the positions of the heat blocks of the heat generation line A are shifted from those of the heat blocks of the heat generation line B in the substrate longitudinal direction, the heat block of the heat generation line B is not present at the same position as that of the end of the heat block A1 in the substrate longitudinal direction. Similarly, the heat block of the heat generation line A is not present at the same position as that of the end of the heat block B20. In the areas of both the ends of this heater, one of the heat generation lines A and B is only present. Consequently, the heat generation amounts at both the ends decrease.

Therefore, in the present example, the heat blocks (A20 and B1) have a constitution different from that of the other heat blocks. FIG. 2C illustrates the constitution of the heat block B1 as a representative of the heat blocks (A20 and B1). The heat block B1 has a block length f in the substrate longitudinal direction which is 1.3 times a block length c of each of the heat blocks B2 to B20 (this also applies to a relation between the heat block A20 and the heat blocks A1 to A19). The block length c or f is the length of an area where the heat generating resistors are present in the heat block, in the heater longitudinal direction. It is to be noted that FIG. 2B illustrates the heat block A1 as a representative of the heat blocks Al to A19 and B2 to B20. Thus, the heat blocks A20 and B1 are provided, to compensate for the drops of the heat generation amounts at both the ends of the heater. Moreover, the heat blocks A20 and B1 are provided to compensate for the drops of the heat generation amounts at both the ends of the heater, but both the ends of the heat generation lines A and B are slightly shifted. This is because, as described above, the heat generation unevenness occurs in the heat block. If the ends of the heat block A1 are superimposed on those of the heat block B1 in the heater longitudinal direction, the heat generation unevenness increases (this also applies to the heat blocks A20 and B20).

Figure 5:
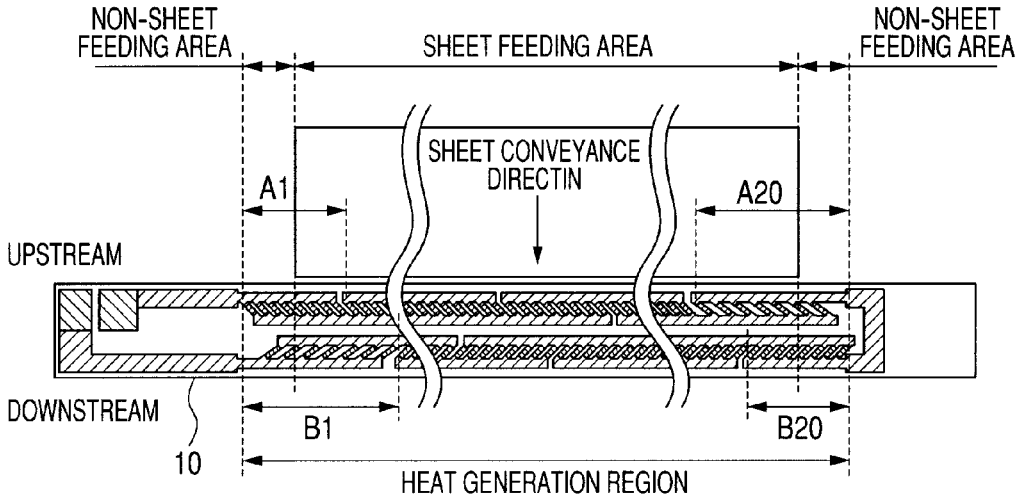
FIG. 5 is a diagram showing a relation between the heater of Example 1 and sheet sizes.

FIG. 5 is a diagram for explaining the temperature rise of the non-sheet feeding portion of the heater 10. FIG. 5 illustrates a case where the center of the heat generation line is a sheet feeding reference, and sheets having an A4 size (210 mm×297 mm) are conveyed whereas the long sides of the sheets are aligned in parallel with the conveyance direction. The heater 10 of FIG. 5 has a heat generation line length of 220 mm (a heat generation region) so that US-letter sheets (about 216 mm×279 mm) are usable. The heat generation line length is larger than a sheet width, so that even when a sheet feeding position shifts in the heater longitudinal direction, the edge of each sheet can sufficiently be heated. When A4 sheets each having a sheet width of 210 mm are subjected to a fixing treatment by use of the heater 10 having a heat generation line length of 220 mm, a 5 mm non-sheet feeding area is generated at each end of the heat generation line. The power is controlled so that the output of the thermistor 4 provided in a sheet feeding portion maintains a target temperature. Therefore, in the non-sheet feeding portion where any heat is not taken by the sheet, the temperature of the heater rises as compared with the sheet feeding portion.

Figure 6A:
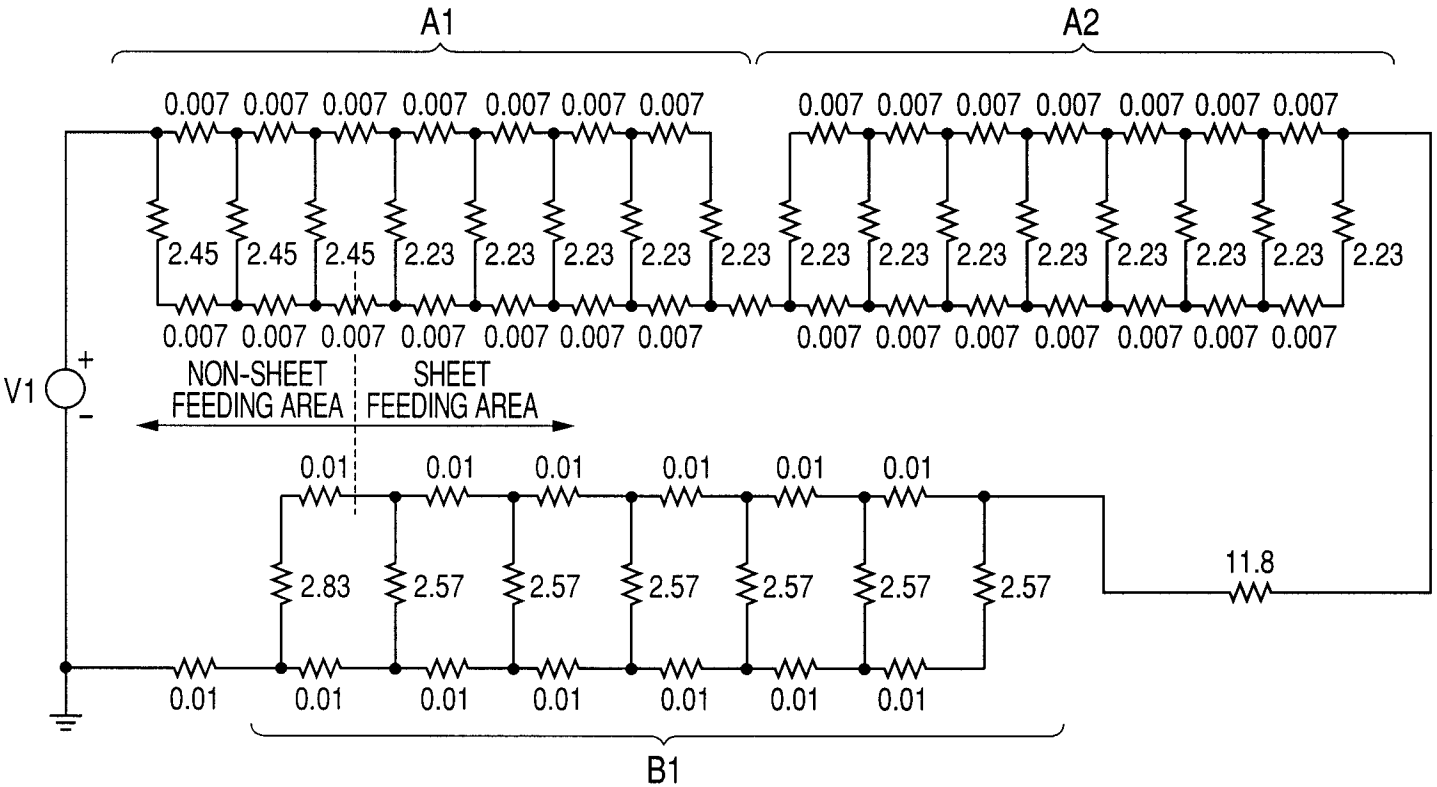
FIGS. 6A, 6B and 6C are explanatory views of a non-sheet feeding portion temperature rise suppression effect of the heater of Example 1.
Figure 6B:
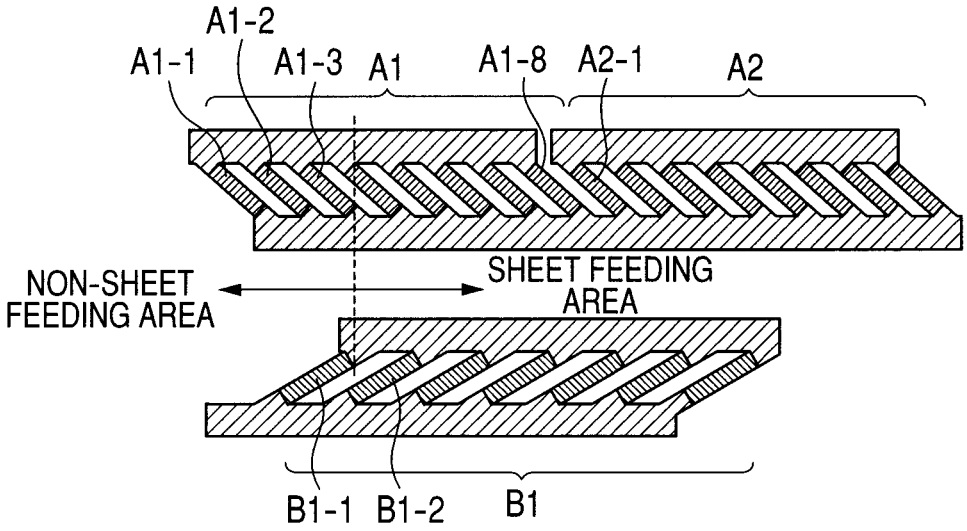
Figure 6C:
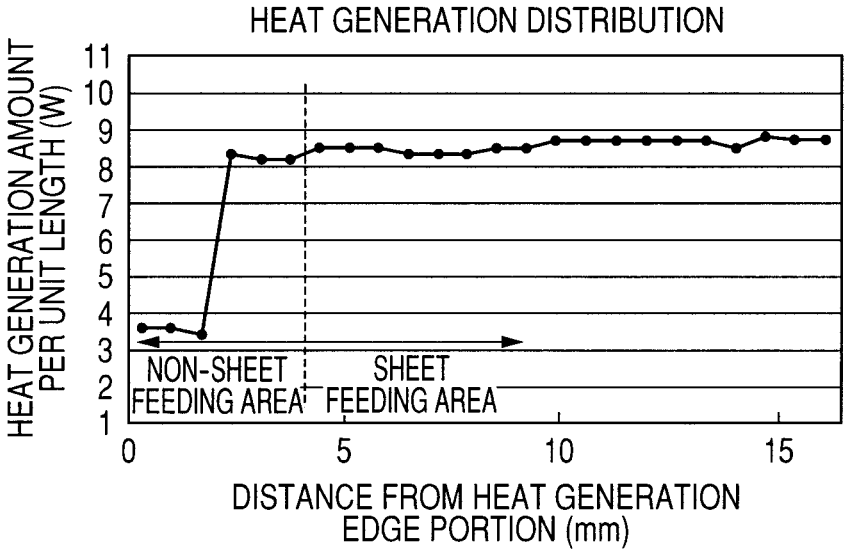

FIGS. 6A to 6C illustrate a simulation circuit diagram and a simulation result for explaining a non-sheet feeding portion temperature rise suppression effect of the heater 10. FIG. 6A illustrates the simulation circuit diagram prepared by simplifying conditions. In the present simulation, the total resistance value of the heater 10 is set to about 12.85Ω. The sheet resistance value of the conductive pattern is set to 0.005Ω/□, and the sheet resistance value of a heat generation paste is set to 0.85Ω/□. Moreover, the resistance temperature coefficient of the heat generation paste is set to 1000 ppm. The resistance value per heat generating resistor included in the heat blocks A1 to A19 and B2 to B20 is 2.23Ω. When the adjacent heat generating resistors in the heat block A1 are connected to each other via a conductive pattern having a line length of 1.3 mm and a line width of 1 mm, the resistance value of the conductive pattern connecting the heat generating resistors to each other is 0.007Ω. The total resistance value of the heat block A1 including such heat generating resistor and conductive pattern is about 0.32Ω. On the other hand, the resistance value per heat generating resistor included in the heat blocks A20 and B1 is 2.57Ω. When the adjacent heat generating resistors in the heat block B1 are connected to each other via the conductive pattern having a line length of 2 mm and a line width of 1 mm, the resistance value of the conductive pattern connecting the heat generating resistors to each other is 0.01Ω. The total resistance value of the heat block B1 including the heat generating resistors and the conductive pattern is about 0.41Ω. FIG. 6A schematically illustrates the synthesized resistance value of the heat blocks other than the heat blocks A1, A2 and B1 necessary for the description. The resistance value of the above heat generating resistor is measured at 200° C.

FIG. 6B is an enlarged view of the heat blocks A1, A2 and B1 according to the present simulation. When the temperature of the sheet feeding area is controlled to 200° C. and the temperature of the non-sheet feeding area rises to 300° C., the simulation is performed. A boundary between the non-sheet feeding area and the sheet feeding area is 4.125 mm away from the left end of the heat generation line A. Since the temperature of the non-sheet feeding area rises to 300° C., owing to the influence of the resistance temperature coefficient of the heat generating resistor, the resistance values of the heat generating resistors A1-1 to A1-3 and the heat generating resistor B1-1 rise as much as 10%, respectively. The resistance temperature coefficient of the conductive pattern has a less influence, and hence a resistance variance due to the temperature is not taken into consideration in the present simulation.

FIG. 6C illustrates the simulation result showing the heat generation distribution of the heater 10 under the above conditions. It is seen from the simulation result that the heat generation amount of the non-sheet feeding area is smaller than that of the sheet feeding area in the heater 10. In the diagram, the ordinate indicates the heat generation amount per unit length in the heater longitudinal direction in consideration of the heat generation amount of the conductive pattern. It is seen that the average heat generation amount of the non-sheet feeding area excluding a region of 2 mm from the left end of the heat generation line A in which the heat generation line B is not present decreases as much as about 4% as compared with the average amount of the sheet feeding area. In this way, while controlling the power so that the output of the thermistor 4 provided in the sheet feeding portion maintains a target temperature, the recording sheets are conveyed so as to generate the boundary between the sheet feeding area and the non-sheet feeding area in the heat block A1. In this case, the temperatures of the heat generating resistors (A1-1 to A1-3) present in the non-sheet feeding area rise. Accordingly, the resistance values of the heat generating resistors (A1-1 to A1-3) rise, and hence the amount of the current flowing through the heat generating resistors (A1-1 to A1-3) can be reduced. Therefore, the temperature rise of the non-sheet feeding portion can be suppressed. When the boundary between the sheet feeding area and the non-sheet feeding area is provided on the shortest heat generating resistor A1-1 of the heat block A1, an effect obtained by connecting the plurality of heat generating resistors in parallel in one heat block deteriorates. The effect of suppressing the temperature rise of the non-sheet feeding portion cannot sufficiently be obtained sometimes. Therefore, as shown in FIG. 5 and FIG. 6B, the heater is designed so that any sheet does not overlap with the heat generating resistor A1-1 in the heat block A1, the heat generating resistor B1-1 in the heat block B1, the heat generating resistor A20-7 in the heat block A20 or the heat generating resistor B20-8 in the heat block B20. In consequence, it is possible to effectively obtain the effect of suppressing the temperature rise of the non-sheet feeding portion.

EXAMPLE 2

Figure 7:
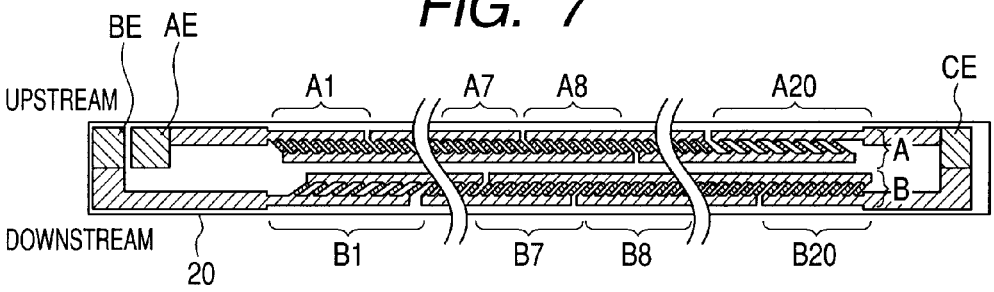
FIG. 7 is a heater constitution diagram of Example 2.

FIG. 7 is a diagram illustrating the constitution of a heater 20 of Example 2. In the heater 20, two heater drive circuits can independently drive a heat generation line A (a first row) and a heat generation line B (a second row). Therefore, unlike the heater 10 of Example 1, an electrode CE is interconnected between the heat generation line A and the heat generation line B. A power is supplied to the heat generation line A through an electrode AE and the electrode CE, and a power is supplied to the heat generation line B through an electrode BE and the electrode CE. The heater has the same constitution as that of the heater 10 except that the electrode CE is added. Thus, the present invention can be applied to the heater having a constitution in which the heat generation lines A and B can independently be controlled.

EXAMPLE 3

Figure 8A:
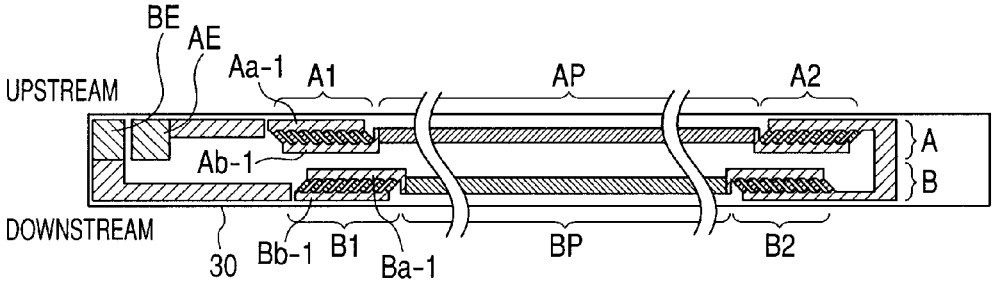
FIGS. 8A and 8B is a heater constitution diagram of Example 3.
Figure 8B:
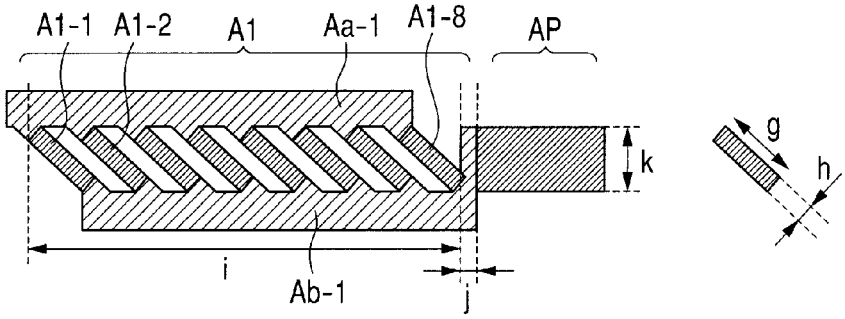

FIGS. 8A and 8B are diagrams illustrating a constitution of a heater 30 of Example 3. As shown in FIG. 8A, heat blocks A1, A2, B1 and B2 are provided at both ends of the heater 20 along a longitudinal direction in the same manner as in the heater 10 of Example 1. Between the heat block A1 and the heat block A2 of a heat generation line A, a heat block obtained by connecting a plurality of heat generating resistors (A1-1 to Al-8 and A3-1 to A3-8) having a PTC in parallel is not provided, but a heat generation pattern AP including one heat generating resistor is connected in series with the heat blocks A1 and A2. A heat generation line B has a constitution similar to the heat generation line A. The heater 30 also obtains a uniform heat generation distribution along a substrate longitudinal direction. To this end, the heat block A1 of the heat generation line A is shifted from the heat block B1 of the heat generation line B in a heater longitudinal direction so that the block completely does not overlap with the heat block B1 in the heater longitudinal direction (the ends of the heat blocks do not overlap with each other). This also applies to a positional relation between the heat block A2 and the heat block B2. Thus, the heat blocks of the respective rows of the heater 30 are provided at the ends thereof in the substrate longitudinal direction, and the heat generation pattern including one heat generating resistor is connected on a sheet feeding reference side from this heat block (in the center along the substrate longitudinal direction in the present example).

FIG. 8B illustrates an enlarged view of the heat block A1 as a representative of four heat blocks and a part of the heat generation pattern AP connected to the heat block A1. In the heat block A1, eight rectangular heat generation patterns each having a line length g and a line width h are arranged, and connected in parallel via conductive patterns Aa-1 and Ab-1. Each of the heat blocks A2, B1 and B2 also have a similar shape. The total resistance value of the heater 30 is set to about 12.85Ω. In the heat blocks A1, A2, B1 and B2, the sheet resistance value of a conductive pattern is set to 0.005Ω/□, the sheet resistance value of the heat generation paste is set to 0.85Ω/□, and the resistance value per heat generating resistor is 2.23Ω. As to the dimensions of each portion, g=1.84 mm, h=0.7 mm and i=10.73 mm. When the adjacent heat generating resistors in the heat block A1 are connected to each other via a conductive pattern having a line length of 1.3 mm and a line width of 1 mm, the resistance value of the conductive pattern between the heat generating resistors is 0.007Ω. The total resistance value of the heat block A1 including such heat generating resistor and conductive pattern is 0.32Ω.

In the heat generation pattern AP, the sheet resistance value of the heat generation paste is set to 0.047Ω/□. The pattern is a strip-like heat generation pattern having a total resistance of 5.9Ω, a line width of 1.6 mm and a length of 198 mm and extending along the heater longitudinal direction. A heat generation pattern BP is slightly shorter than the heat generation pattern AP. In the pattern, the sheet resistance value of the heat generation paste is set to 0.047Ω/□. The pattern is a strip-like heat generation pattern having a total resistance of 5.8Ω, a line width of 1.6 mm and a length of 198 mm and extending along the heater longitudinal direction. The heat block A1 is connected to the heat generation pattern AP via a conductive pattern (j=0.27 mm). Thus, a material of a sheet resistor of the heat generating resistor in the heat block A1 is used. The material has a resistance value which is different from that of a material of a sheet resistor of the heat generation pattern AP. In consequence, the heat generation amount per unit length is regulated. As shown in FIG. 8B, when the heat block A1 and the heat generation pattern AP are connected in series, a discontinuous heat generation distribution occurs in a conductive pattern portion of a space between the block and the pattern sometimes. However, the heat block A1 of the heat generation line A is shifted from the heat block B1 of the heat generation line B in the heater longitudinal direction so that the heat blocks completely do not overlap with each other in the heater longitudinal direction. In consequence, the influence of the discontinuous heat generation distribution occurring in the space can be alleviated.

Next, Examples 4 to 7 will be described as an example in which when a recording material having a specific size is fed, the temperature rise of a non-sheet feeding portion is suppressed while suppressing heat generation unevenness.

Figure 13:
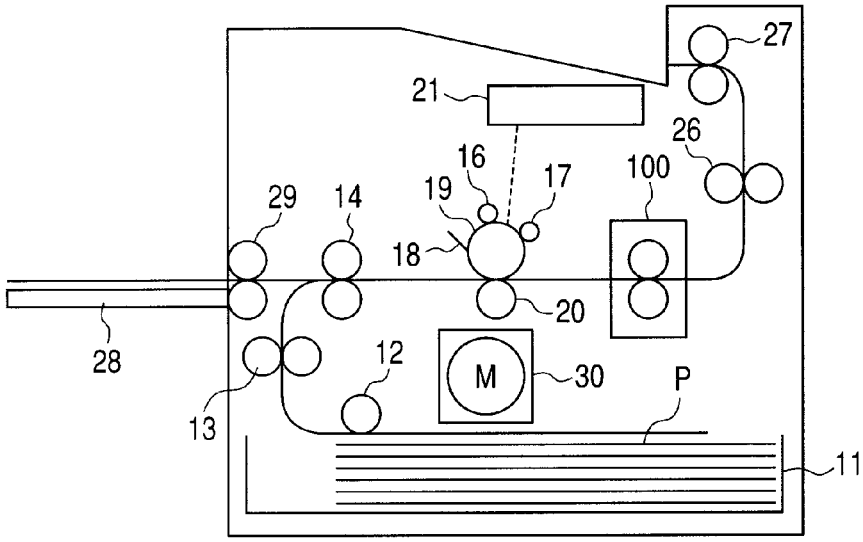
FIG. 13 is a sectional view of an image forming apparatus of the present invention.

FIG. 13 is a sectional view of a laser printer (an image forming apparatus) using an electronic photograph recording technology. When a print signal is generated, laser light modulated in accordance with image information is emitted from a scanner unit 21, and a charging roller 16 scans a photosensitive member 19 charged with a predetermined polarity. In consequence, an electrostatic latent image is formed on the photosensitive member 19.

A developer 17 supplies toner to this electrostatic latent image, to form a toner image on the photosensitive member 19 in accordance with the image information.

On the other hand, recording materials (recording sheets) P stacked in a feeding cassette 11 are supplied to a pickup roller 12 sheet by sheet, and conveyed to registration rollers 14 by rollers 13. Furthermore, the recording material is conveyed from the registration roller 14 to a transfer position, when the toner image on the photosensitive member 19 reaches the transfer position formed by the photosensitive drum 19 and a transfer roller 20. While the recording material P passes through the transfer position, the toner image on the photosensitive member 19 is transferred to the recording material P.

Afterward, the recording material P is heated in a fixing portion 100, and the toner image is heated and fixed on the recording material P. The recording material P having the fixed toner image is discharged onto a tray in the upper part of a printer by rollers 26 and 27. It is to be noted that the photosensitive member 19 is cleaned by a cleaner 18. A sheet feeding tray (a manual sheet feeding tray) 28 includes a pair of recording material regulation plates in which a distances in a width direction is adjustable according to the size of the recording material.

The sheet feeding tray 28 is provided to receive recording materials having a standard size and another size. The recording material is supplied from the sheet feeding tray 28 by pickup rollers 29. The fixing portion 100 is driven by a motor 30. The photosensitive member 19, the charging roller 16, the scanner unit 21, the developer 17 and the transfer roller 20 constitute an image forming part which forms an unfixed image on the recording material.

The printer f the present example is a printer for an A4-size (210 mm×297 mm) corresponding to a letter size (about 216 mm×279 mm). That is, the printer basically vertically feeds A4-size sheets (so that the long sides of the sheets are parallel to a conveyance direction), but the printer is also designed to vertically feed letter-size sheets each having a width slightly larger than the A4-size.

Therefore, the largest size (with the large width) of the standard size of the recording material to be printed by the printer (a corresponding sheet size on a catalog) is the letter size.

EXAMPLE 4

Figure 9A:
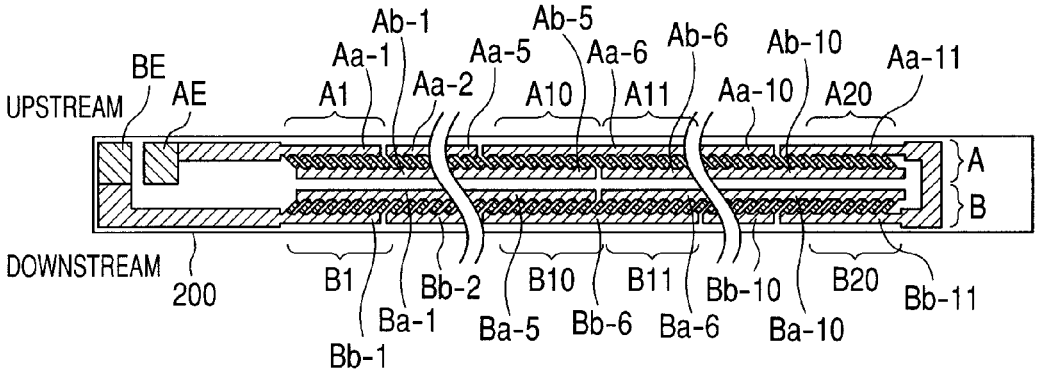
FIGS. 9A, 9B and 9C are heater constitution diagrams of Example 4.
Figure 9B:
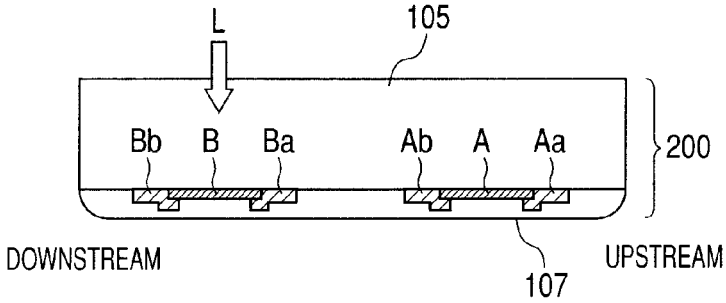
Figure 9C:
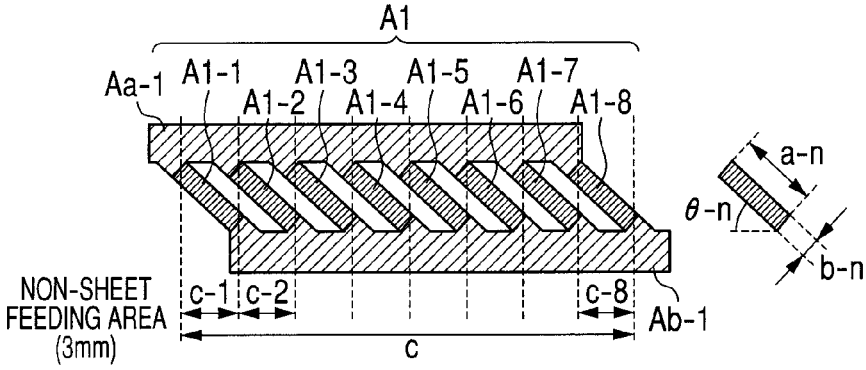

FIGS. 9A to 9C are diagrams for explaining the structure of a heater. FIG. 9A is a plan view of the heater, FIG. 9B is a sectional view of the heater and FIG. 9C is an enlarged view showing one heat block A1 in a heat generation line A. It is to be noted that each of a heat generating resistor in the heat generation line A and a heat generating resistor in a heat generation line B has a PTC.

The heat generation line A (a first row) includes 20 heat blocks A1 to A20, and the heat blocks A1 to A20 are connected in series. The heat generation line B (a second row) includes 20 heat blocks B1 to B20, and the heat blocks B1 to B20 are connected in series.

Moreover, the heat generation lines A and B are also electrically connected in series. A power is supplied to the heat generation lines A and B from electrodes AE and BE connected to a power supplying connector. The heat generation line A includes a conductive pattern Aa (a first conductive member of the heat generation line A) provided along a substrate longitudinal direction, and a conductive pattern Ab (a second conductive member of the heat generation line A) provided along the substrate longitudinal direction at a position different from that of the conductive pattern Aa in a lateral direction of a substrate. The conductive pattern Aa is divided into eleven patterns (Aa-1 to Aa-11) in the longitudinal direction of the substrate.

The conductive pattern Ab is divided into ten patterns (Ab-1 to Ab-10) in the substrate longitudinal direction. The constitution of the heat generation line B is similar to the heat generation line A, and hence the description thereof is omitted.

FIG. 9B illustrates a sectional view of a heater 200.

When the heater 200 is manufactured, first, heat generating resistors A and B are formed on a heater substrate 105. Afterward, conductive patterns Aa, Ab, Ba and Bb are formed. Finally, a surface protective layer 107 is formed.

The heater is formed in such an order. Therefore, as seen from the cross section of the heater in FIG. 9B, the conductive patterns cover the heat generating resistors (FIG. 9B is illustrated in the same heater direction as that of FIG. 1, and hence the subsequently formed layer is shown on the downside).

When the conductive patterns are formed on the heater substrate 105 before the heat generating resistors, a part of each heat generating resistor covers each conductive pattern, and the sectional shape of the heat generating resistor is deformed. The resistance value of the heat generating resistor is proportional to the length thereof, and is inversely proportional to the width thereof. However, when the sectional shape is deformed, a current flowing area in the heat generating resistor varies, and the resistance value suitable for the size of the heat generating resistor is not indicated sometimes (an area seen along the direction of an arrow L in FIG. 9B). Therefore, the resistance value of the heat generating resistor is not easily set to a design value.

However, when the heat generating resistors are formed before the conductive patterns as in the present example, the sectional shape of each heat generating resistor does not vary. Therefore, the present example has a merit that the resistance value of the heat generating resistor is easily set to the design value.

FIG. 9C illustrates a detailed diagram of the heat block A1. As shown in FIG. 9C, a plurality of (eight in the present example) heat generating resistors (A1-1 to A1-8) are electrically connected in parallel between the conductive pattern Aa-1 as a part of the heat conductive pattern Aa and the conductive pattern Ab-1 as a part of the conductive pattern Ab, to form the heat block A1. The size (a line length (a-n)×a line width (b-n)) and a layout (a space (c-n))) and the resistance value of each heat generating resistor in the heat block A1 are shown in FIG. 9C.

As shown FIGS. 9A to 9C, the heat generating resistors are obliquely tilted (angle θ) and arranged along the substrate longitudinal direction and a recording material conveyance direction. It is to be noted that as shown in FIG. 9C, a heat block length c is defined as the length from the center of the lateral (short) side of the heat generating resistor at the left end to the center of the lateral (short) side of the heat generating resistor at the right end along a heater longitudinal direction.

In the heater 200, heat generation resistive spaces c-1 to c-8 are equal not only in the heat block A1 but also in the other heat blocks, and all the spaces are c/8. In the heat block A1, the line width of the heat generating resistor is varied so as to obtain a uniform heat generation distribution of the heat block in the longitudinal direction of the heater. In consequence, the uniformity of the heat generation amounts of the heat generating resistors A1-1 to A1-8 is improved.

In the heat block A1, the line width b-n of each heat generating resistor is set so that the heat generating resistors (A1-4 and A1-5) in the center have a lower resistance value and the heat generating resistors (A1-1 and A1-8) at the ends have a higher resistance value. The table shown in FIG. 9C shows the sizes and resistance values of eight heat generating resistors in the heat block A1.

Here, the lengths (a-n: a-1 to a-8) and spaces (c-n: c-1 to c-8) of the heat generating resistors are set to be constant, and the line widths (b-n: b-1 to b-8) of the heat generating resistors are varied, to obtain the uniform heat generation distribution of the heat block A1. The resistance value of each heat generating resistor is proportional to the length/line width. Therefore, the length of the heat generating resistor may be varied in the same manner as in the line width, to regulate the resistance value of the heat generating resistor. Moreover, when the heat generating resistor has a rectangular shape as shown in FIG. 9C, the distribution of the current flowing through the heat generating resistors can be uniform.

When, for example, the heat generating resistor has a parallelogram shape, a large amount of current flows through the shortest path of the resistor. Therefore, although the distribution of the current flowing through the heat generating resistors may not be uniform, when the shape is changed to the rectangular shape, the current easily uniformly flows through the whole heat generating resistor.

However, the effect of suppressing the temperature rise of the non-sheet feeding portion can be obtained, also when the heat generating resistor having the parallelogram shape is used. The shape of the heat generating resistor is not limited to the rectangular shape. Moreover, as shown in FIG. 9C, the plurality of heat generating resistors are obliquely tilted and arranged in the longitudinal direction and recording material conveyance direction to obtain such a positional relation that in the one heat block, the shortest current path of each of the heat generating resistors overlaps with the shortest current path of the heat generating resistors provided adjacent to each other along the substrate longitudinal direction, in the longitudinal direction.

This positional relation also applies to a relation between the endmost heat generating resistor in one heat block (e.g., the shortest heat generating resistor A1-8 on the right side of the heat block A1) and the shortest heat generating resistor in the adjacent heat block (e.g., the shortest heat generating resistor A2-1 on the left side of the heat block A2). Since the heat generating resistor of the present example has a rectangular shape, the whole heat generating resistor is the shortest current path.

In the present example, as shown in FIG. 9C, the respective heat generating resistors are arranged so that the center of the lateral side of the rectangular shape of the one heat generating resistor overlaps with the center of the lateral side of the rectangular shape of the adjacent heat generating resistor along the substrate longitudinal direction.

Figure 10:
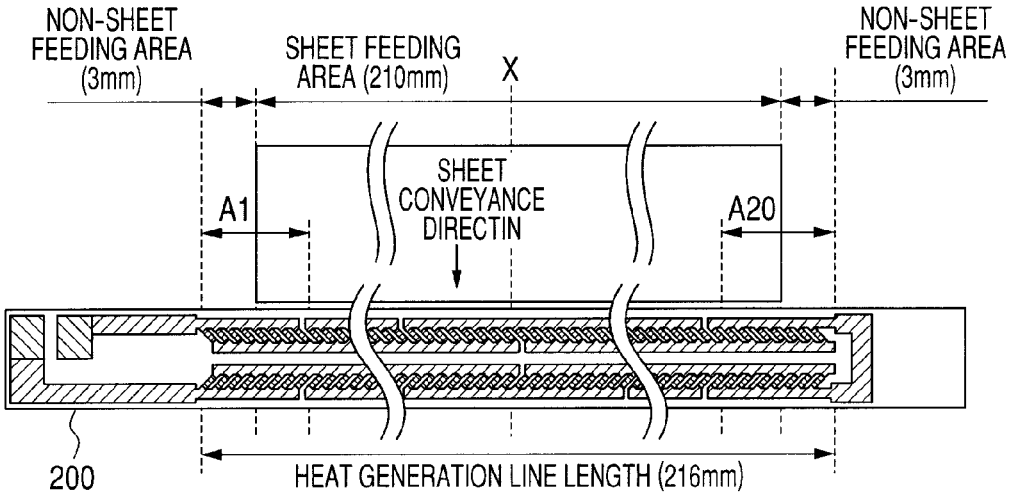
FIG. 10 is a diagram showing a relation between the heater of Example 4 and sheet sizes.

FIG. 10 is a diagram for explaining the temperature rise of the non-sheet feeding portion of the heater 200. This heater is provided so that the center of an area provided with the heat generating resistors (a heat generation line length) in the substrate longitudinal direction matches a recording material conveyance reference X. In the present example, sheets each having an A4-size (210 mm×297 mm) are vertically fed (so that the side having a size of 297 mm is parallel to the conveyance direction). In this example, the feeding cassette 11, the sheet feeding tray 28, various conveyance rollers and a fixing portion are arranged so that the center of the 210 mm long side of the A-4 size sheet matches the reference X).

As shown in FIGS. 9A to 9C and FIG. 10, in the area provided with the heat generating resistors (=the heat generation line length), a portion most distant from the recording material conveyance reference X in the substrate longitudinal direction has the structure of the heat block including a plurality of heat generating resistors connected in parallel (A1 (B1) and A20 (B20)). The heat generation line length of the heater is set to 216 mm so that sheets each having a letter size (about 216 mm×279 mm) can vertically be fed and printed.

In addition, as described above, the printer of the present example corresponds to the letter size, but basically corresponds to the A4-size sheets. Therefore, the printer is suitable for a user who most frequently utilizes the A4-size sheets. However, the printer also corresponds to the letter size. Therefore, when the A4-size sheets are printed, a 3 mm non-sheet feeding area is formed at each end of the heat generation line. The power to be supplied to the heater is controlled so that during a fixing treatment, a temperature detected by a temperature detection element 111 for detecting the temperature of the heater near the recording material conveyance reference X is kept at a control target temperature. In consequence, in order to prevent heat from dissipating by a sheet in the non-sheet feeding portion, and hence the temperature of the non-sheet feeding portion rises as compared with the sheet feeding portion. It is to be noted that in the present example, the letter size is the maximum size, and the A4-size is a specific size.

Figure 11A:
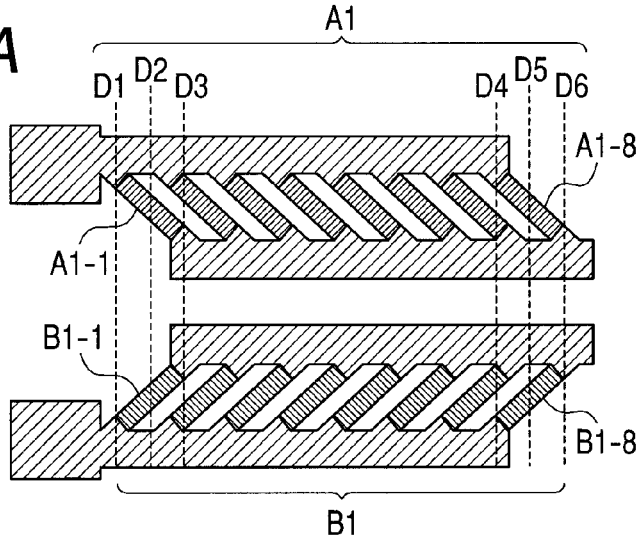
FIGS. 11A, 11B and 11C are explanatory views of the non-sheet feeding portion temperature rise suppression effect of the heater of Example 4.
Figure 11B:
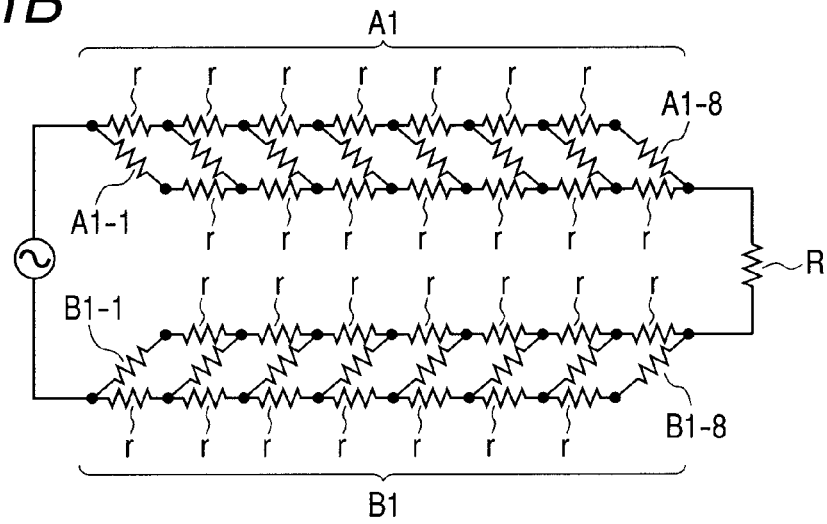
Figure 11C:
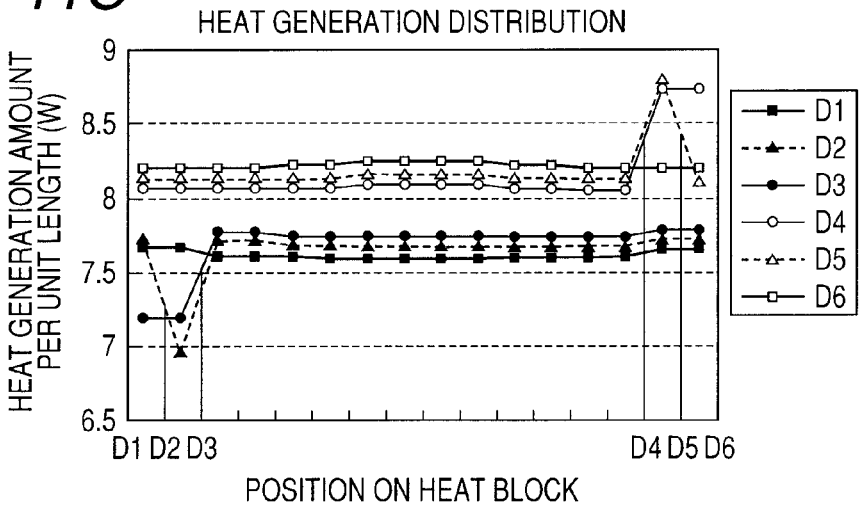

FIGS. 11A to 11C illustrate a relation between the heat generating resistors formed on the heater substrate and the feeding position of the edge of the recording material (FIG. 11A), a circuit diagram of a heater used in the simulation of the temperature rise of the non-sheet feeding portion (FIG. 11B) and a diagram (FIG. 11C) showing the simulation results of the feeding position of the recording material and the heat generation distribution of the heater.

FIG. 11A illustrates a positional relation between the heat blocks A1 and B1 and the edge of the recording material. The positions of the edges of the recording materials from the left ends of the heat generation lines A and B are D1 (0 mm), D2 (1.0 mm), D3 (2.0 mm), D4 (9.5 mm), D5 (10.4 mm) and D6 (11.4 mm), respectively.

In the present example, through the position D1, the edge of the sheet having the letter size passes, when the sheet is aligned with the reference X and conveyed. Moreover, at the positions D2 and D5, it is supposed that the edge of the recording material passes through the heat generating resistors (A1-1, A1-8, B1-1 and B1-8) at both the ends of the heat blocks A1 and B1. At the positions D3 and D4, it is supposed that the edge of the recording material does not pass through the heat generating resistors (A1-1, A1-8, B1-1 and B1-8) at both the ends of the heat blocks A1 and B1.

In the simulation result of FIG. 11C, it is supposed that the heater is controlled to a control target temperature 200, and the temperature of the non-sheet feeding area rises up to 300° C. It is to be noted that the resistance temperature coefficient of the heat generating resistor of the present example is 1000 ppm, and the resistance value of the heat generating resistor having the temperature raised to 300° C. increases as much as 10% with respect to the heat generating resistor at 200° C.

FIG. 11B is a simulation circuit diagram prepared by simplifying conditions. The sheet resistance value of the conductive pattern is 0.005Ω/□, and the sheet resistance value of the heat generation paste is 0.75Ω/□ (in the case of 200° C.) as calculation conditions. The resistance values of the heat generation patterns A1-1 and A1-8 included in the heat block A1 are 2.23Ω, the resistance values of the heat generation patterns A1-2 and A1-7 are 2.06Ω, the resistance values of the heat generation patterns A1-3 and A1-6 are 1.95Ω, the resistance values of the heat generation patterns A1-4 and A1-5 are 1.89Ω.

Both ends of the adjacent heat generation patterns in the heat block are connected via a conductive pattern having a line length of 1.35 mm and a line width of 1 mm. On such simplified conditions, the resistance value r of the conductive pattern connected to the heat generation patterns is 0.007Ω. The description of the heat block B1 is similar to the heat block A1, and is therefore omitted. In FIG. 11B, the heat block other than the heat blocks A1 and B1 necessary for the description is simply shown as a synthesized resistance value R.

When the temperature of the heat generation pattern of the non-sheet feeding portion reaches 300° C. or higher, a roller portion 110 made of an elastic material such as heat-resistant rubber in a pressure roller 108, a film 102 and a film guide 101 reach the limit of the heat-resistant temperature, and a fixing unit might be damaged. Therefore, the raised temperature of the non-sheet feeding portion is set to 300° C. The above set temperature varies in accordance with a material or a constitution, and the temperature is not especially limited to this temperature. Moreover, a continuous temperature distribution is actually present in the non-sheet feeding area and the end of the sheet feeding area. However, for the sake of simplicity, on the border of D1 to D6 in FIG. 11A in a boundary between the non-sheet feeding area and the sheet feeding area, the temperature rises up to 300° C. in the non-sheet feeding area, and the temperature of the sheet feeding area is set to 200° C., to perform simulation. The conductive pattern has a low resistance value, and is only little influenced by resistance variance due to temperature rise. Therefore, in the present simulation, the resistance variation of the conductive pattern according to the temperature is not taken into consideration.

FIG. 11C illustrates a simulation result showing the heat generation distribution of the heater 200 on the above conditions. It is seen from the simulation result that when the edge positions of the recording material are D3 and D4, the heat generation amount of the non-sheet feeding area is suppressed as compared with the sheet feeding area. It is seen that when the edge position of the recording material is D6, a difference in the heat generation amount between the sheet feeding area and the non-sheet feeding area is eliminated, and the effect of decreasing the heat generation amount of the non-sheet feeding portion cannot be obtained. When the edge position of the recording material is the position D6 in the space between the heat blocks, a plurality of heat blocks are electrically connected in series, and hence the resistance values of the heat blocks A1 and B1 rise owing to the temperature rise of the non-sheet feeding portion.

When the edge of the recording material is present at the position D1, the ends of the heat generation line matches the edges of the sheet, and the non-sheet feeding area is eliminated. It is seen that when the edge positions of the recording material are D2 and D5, the effect of suppressing the temperature rise of the non-sheet feeding portion deteriorates as compared with the case of the edge positions D3 and D4.

Therefore, the heat generation patterns and heat blocks are formed so that the edge of the small-size sheet (the A4-sheet) passes inside the heat generation pattern at each end of the heat block (between D3 and D4 of FIG. 11A). In consequence, it is possible to effectively obtain the effect of suppressing the temperature rise of the non-sheet feeding portion of the heater 200.

In the above simulation, the heat generation amount has been described in a case where the temperature of the non-sheet feeding area reaches 300° C. However, when the edge of the sheet having a specific size passes between D3 and D4 in FIG. 11A, it can prevent the temperature rise of the non-sheet feeding area. In the heater 200, when the temperature of the non-sheet feeding area rises, as shown in FIGS. 11A to 11C, the heat generation amount of the non-sheet feeding area can be controlled, to suppress the temperature rise of the non-sheet feeding portion.

As described with reference to FIGS. 11A to 11C, the heat blocks on both the heat generation lines A and B are desirably formed so that the edge of the small-size sheet passes inside the heat generation pattern at each end of the heat block. However, when the length of the heat generation line A along the substrate longitudinal direction is different from that of the heat generation line B, the shape of the heat block at the endmost portion of the longer heat generation line is designed in consideration of the specific-size sheet. In this case, the above effect can be obtained.

Meanwhile, it is considered that especially when the sheet is supplied from the sheet feeding tray 28, a user mistakenly supplies the A4-size sheet along a recording sheet regulating plate in a state where the recording sheet position regulating sheet is widely positioned with a distance for a letter size. That is, the A4-size sheet is not aligned with the recording material conveyance reference X but is supplied in the case of so-called one-sided sheet feeding. In this case, the non-sheet feeding portion having a size of 6 mm is formed on one side of the heat generation line. This one-sided sheet feeding might occur, also when the sheet is supplied from the feeding cassette 11. For example, the one-sided sheet feeding might occur in a case where after setting the sheets in the feeding cassette 11, the feeding cassette is returned into the main body of the image forming apparatus while the position of the sheet is not regulated by the sheet position regulation plate in the feeding cassette.

It is preferable to design the shape of the heat generating resistor in consideration of the aforementioned irregular case. In the heater having a heat generation line length of 216 mm as described above, when the A4-size sheet (the small-size sheet having a size of 210 mm) having the center thereof aligned as a reference is vertically fed, the width of the non-sheet feeding area is 3 mm. When the sheet is aligned with one side of the heat generation line and fed, the width of the non-sheet feeding area is 6 mm. In each case, the edge of the sheet is passed between D3 and D4 in the heater 200. Consequently, in the heater 200, when the center of the A4-size sheet is aligned as the reference and the sheet is fed and when the one-sided sheet is fed, the effect of suppressing the temperature rise of the non-sheet feeding portion can be obtained.

It is to be noted that in the present example, the printer for the A4-size (210 mm×297 mm) corresponding to the letter size (about 216 mm×279 mm) has been described. However, the present invention can also be applied to a A3-size vertical feeding printer (a width of 300 mm) for SRA3-size (an A3 elongated size) vertical feeding (a width of 320 mm) and an A3 vertical feeding (300 mm) printer corresponding to a letter-size horizontal feeding (279 mm).

Figure 12:
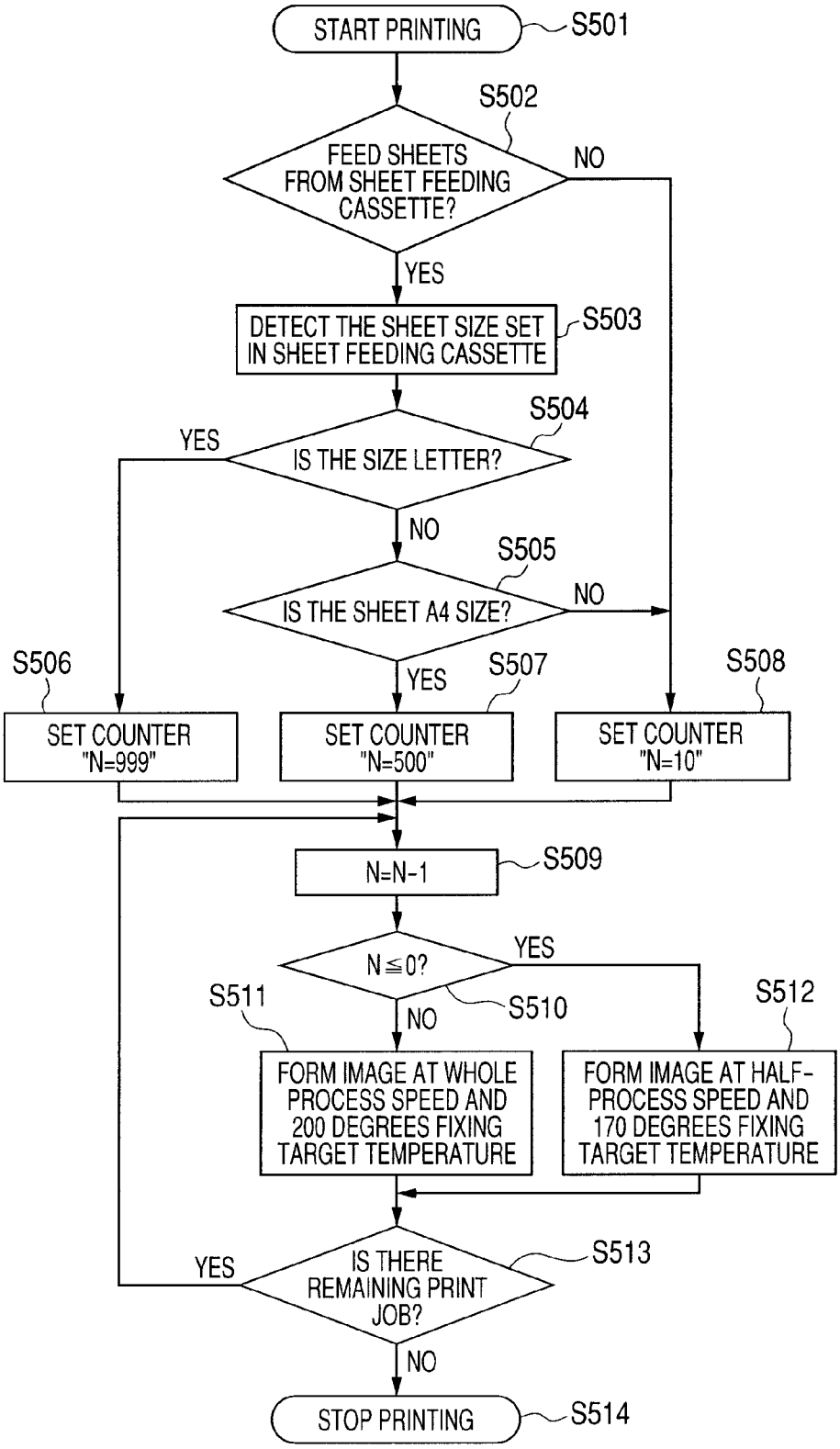
FIG. 12 is a heater control flowchart of Example 4.

FIG. 12 is a flowchart for explaining the control sequence of the fixing unit 100 by a control part (CPU) (not shown). In Example 1, the image forming apparatus is described in which two sheet sizes, i.e., the letter size and the A4-size sheet are standard sheet sizes, and non-standard sheets fed from the manual sheet feeding tray 28 are printable.

The maximum processing speed of this printer is 42 ppm. In S501, it is judged whether or not a printing start request occurs. When the request occurs, the processing proceeds to S502. In S502, it is judged whether the standard sheet fed from the feeding cassette 11 or the non-standard sheet fed from the manual sheet feeding tray 28 is printed. In the case of the standard sheet printing, the processing advances to S503 in which the size of the recording material set in the feeding cassette 11 is detected. In S504, it is judged whether or not the size of the recording material is the letter size. When the size of the recording material is the letter size, the processing proceeds to S506 to set a counter to N=9999.

This counter indicates the number of the sheets allowed to be continuously printed at the maximum processing speed. In the case of the letter size, the non-sheet feeding portion is not generated, and hence the number is set to N=9999 (=infinite). That is, the sheets can infinitely be output at a speed of 42 ppm. In S505, it is judged whether or not the size of the recording material is the A4-size. When the size of the recording material is the A4-size, the processing advances to S507 to set the counter to N=500.

In the case of the A4-size, the number of the sheets allowed to be continuously printed at the maximum processing speed (42 ppm) is 500. When the heat generating resistor does not have the shape in consideration of the above A4-size sheet, a counter value has to be set to a small value in the case of the A4-size sheet. When the sheets set in the sheet feeding cassette 11 have a size smaller than the A4-size or when the non-standard sheets fed from the manual sheet feeding tray 28 are printed, the processing advances to S508 to set the counter to N=10. In S509, subtraction processing of "N=N–1" is performed. It is judged in S510 whether or not the counter N is below 0. When the counter N is not equal to or not less than 0 (i.e., equal to or more than 1), the processing advances to S511 to performs a usual image forming step.

In S511, the control target temperature (the fixing target temperature) of the heater 200 is set to 200° C., and a process speed is set to the whole process speed to perform print processing (the processing at a speed of 42 ppm). When the counter N is equal to or less than in S510, the processing proceeds to S512 to lower the control target temperature (the fixing target temperature) of the heater 200 to 170° C. Moreover, the throughput of the image forming apparatus is lowered, and the process speed is set to a half-process speed (the processing at a speed of 21 ppm) to perform the print processing. When the process speed is set to the half-process speed, the movement speed of the sheet in the fixing nip portion is the half. Therefore, as compared with the whole process speed, fixing properties can be acquired at a low heater temperature. Moreover, the fixing target temperature is lowered, and hence the temperature of the non-sheet feeding portion can be suppressed.

In S513, the above processing is repeatedly performed until any remaining print job is not present, to set the throughput of the image forming apparatus, the image forming process speed and the fixing target temperature. When the sheet size is the letter size, the length of the heat generation line of the heater 200 is designed to be optimized to the letter size. Therefore, even when the maximum number of the sheets to be printed are continuously fed in the image forming apparatus, the temperature rise of the non-sheet feeding portion hardly occurs at all.

Therefore, the value of the counter is set to N=9999, and any restriction is not set to the number of the sheets to be continuously printed. When the sheet size is A4, the temperature rise of the non-sheet feeding portion occurs. However, the effect of suppressing the temperature rise of the non-sheet feeding portion can be obtained as described with reference to FIGS. 11A to 11C. Therefore, even when 500 sheets are continuously printed with the whole process speed at a fixing target temperature of 200° C., the fixing unit is not damaged. When the sheet size is the non-standard size, the effect of suppressing the temperature rise of the non-sheet feeding portion deteriorates sometimes as described with reference to FIGS. 11A to 11C. Therefore, the number of the continuously printable sheets with the whole process speed (42 ppm) is limited to ten. It is to be noted that in a usual printer, the sheet size other than the letter size and the A4-size is set as the standard size. To prevent the temperature rise of the non-sheet feeding portion for each of the standard sizes other than the letter size and the A4-size, the counter value, the throughput of the image forming apparatus, the process speed of the image forming apparatus and the fixing target temperature may individually be set.

Moreover, in the image forming apparatus including a thermistor as a second temperature detection element near the end of the heat generation line of the heater 200, when the temperature detected by the end thermistor reaches a predetermined threshold value, control may be performed so as to decrease the throughput of the image forming apparatus, set the image forming process speed to the half and lower the fixing target temperature to 170° C.

Furthermore, in the case of the non-standard sheet size, the predetermined threshold value at which the throughput is lowered may be set to be lower as compared with the case of the standard sheet size. The control can be performed as shown in the flowchart of FIG. 12 to obtain the more appropriate non-sheet feeding portion temperature rise suppression effect.

As described above, i) In the area provided with the heat generating resistors, the portion most distant from the recording material conveyance reference in the substrate longitudinal direction has the structure of the heat block including the plurality of heat generating resistors connected in parallel, ii) The plurality of heat generating resistors are obliquely tilted and arranged with respect to the longitudinal direction and recording material conveyance direction to obtain such a positional relation that the shortest current path of each of the heat generating resistors overlaps with the shortest current path of the heat generating resistors provided adjacent to each other along the longitudinal direction, in the longitudinal direction and iii) The plurality of heat generating resistors are arranged so that the side of the edge of the recording material in the longitudinal direction does not pass through the areas provided with the heat generating resistors in the heat block provided in the endmost portion, when the recording material having at least one specific size of the sizes smaller than the largest standard recording material size dealt by the apparatus passes through the nip portion. When the heater having such a constitution is used, there can be provided the image forming apparatus in which the temperature rise of the non-sheet feeding portion in a case where the recording material having the specific size is fed can be suppressed while suppressing the heat generation unevenness.

EXAMPLE 5

Next, Example 5 will be described. In the example, the heater to be provided in the fixing portion of the image forming apparatus is changed. Description of a constitution similar to Example 4 is omitted.

Figure 14:
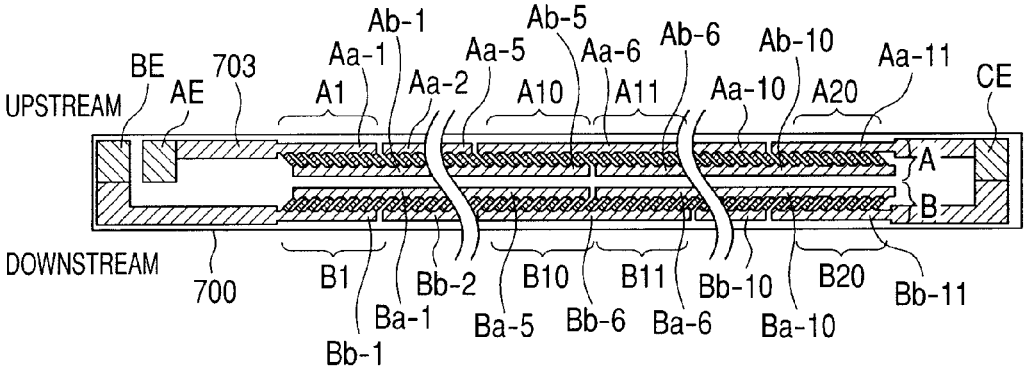
FIG. 14 is a heater constitution diagram of Example 5.

FIG. 14 is a diagram showing the constitution of a heater 700 of Example 2. In the heater 700, two heater drive circuits can independently drive a heat generation line A (a first row) and a heat generation line B (a second row). In this constitution, unlike the heater 200 of Example 1, an electrode CE is interconnected between the heat generation line A and the heat generation line B. A power is supplied to the heat generation line A via an electrode AE and the electrode CE, and a power is supplied to the heat generation line B via a electrode BE and the electrode CE. The constitution is the same as that of the heater 200 except that the electrode CE is added. Thus, the present invention can be applied to the heater which can independently control the heat generation lines A and B.

EXAMPLE 6

Next, Example 6 will be described. In the example, the heater to be provided in the fixing portion of the image forming apparatus is changed. Description of a constitution similar to Example 4 is omitted.

Figure 15A:
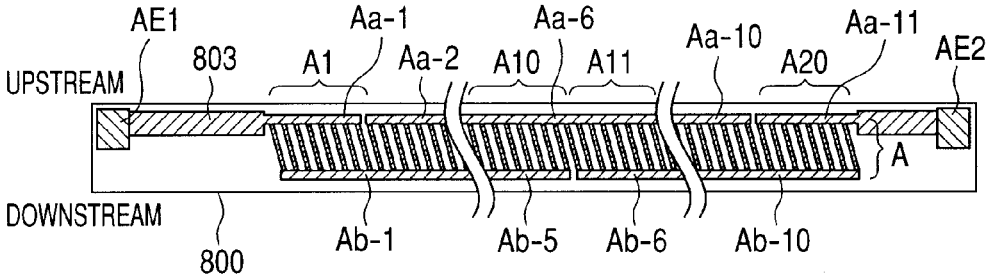
FIGS. 15A and 15B are heater constitution diagrams of Example 6.
Figure 15B:
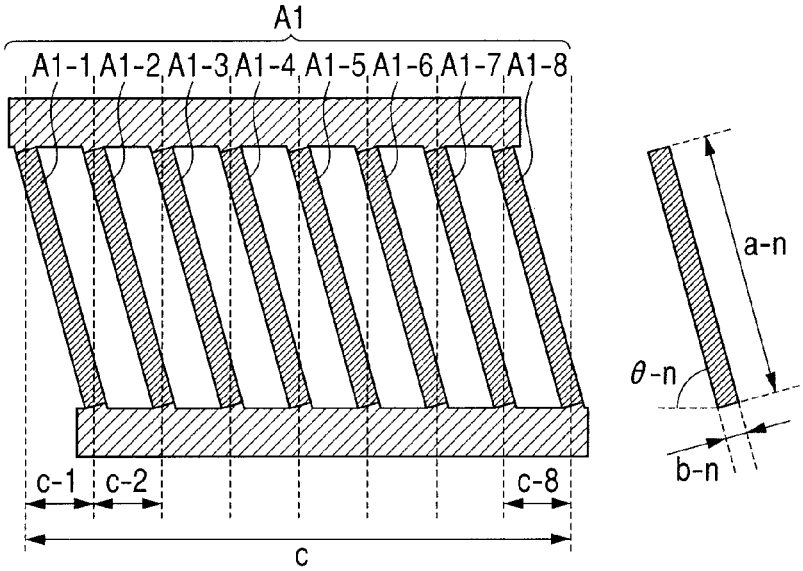

FIGS. 15A and 15B are schematic diagrams for explaining a heater 800. FIG. 15A illustrates the heat generation pattern and conductive pattern of the heater 800. The heater 800 includes a heat generation line A. The heat generation line A is divided into 20 heat blocks, and the respective heat blocks are connected in series. In the heater 800, a power is supplied to the heat generation line A through electrodes AE1 and AE2. FIG. 15B illustrates a detailed diagram of a heat block A1.

In the heat block A1, eight heat generation patterns, i.e., a heat generation pattern A1-1 having a line length a-1, line width b-1 and tilt 8-1 to a heat generation pattern A1-8 having a line length a-8, line width b-8 and tilt 8-8 are arranged with spaces c-1 to c-8, and the patterns are connected in parallel via the conductive pattern. The heat block A1 is characterized by obtaining the uniform heat generation distribution of the heat block in the heater longitudinal direction, the space between the heat generation patterns and the tilt are changed to increase the density of the heat generation patterns A1-1 to Al-8 toward the center of the heat block. The present invention can be applied to the use of a heater which does not include any heat generation line (only one heat generation line) as shown in FIGS. 15A and 15B.

EXAMPLE 7

Figure 16A:
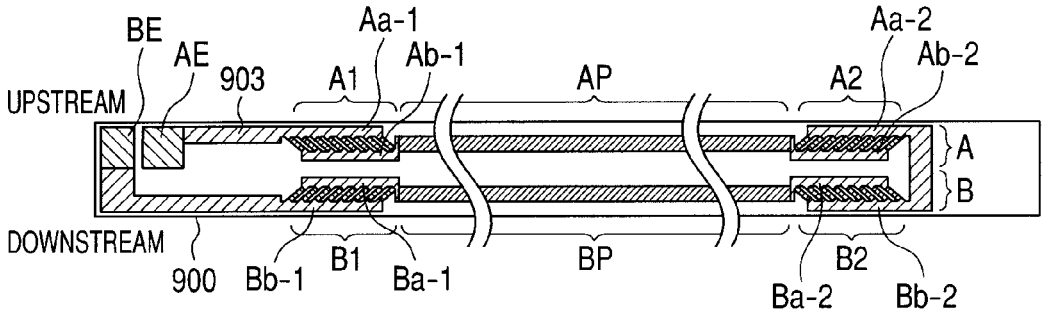
FIGS. 16A and 16B are heater constitution diagrams of Example 7.
Figure 16B:
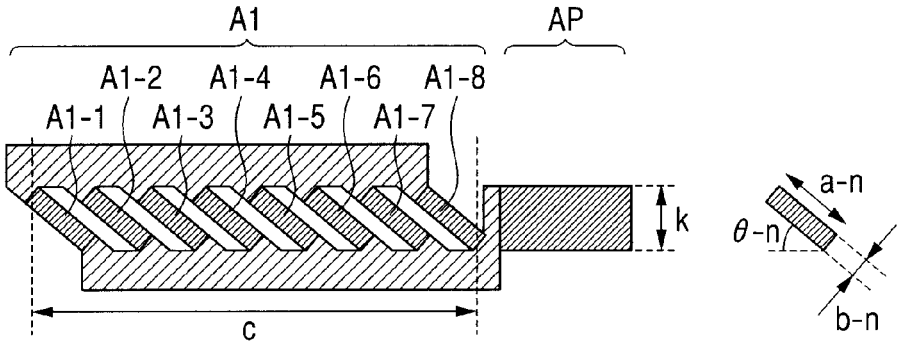

FIGS. 16A and 16B are diagrams showing a constitution of a heater 900 of Example 7. As shown in FIG. 16A, heat blocks A1, A2, B1 and B2 are provided at both ends of the heater 900 in a longitudinal direction in the same manner as in the heater 200 of Example 4. Between the heat blocks A1 and A2 of the heat generation line A, a heat generation pattern AP including one heat generating resistor is connected in series with the heat blocks A1 and A2. A heat generation line B has a constitution similar to the heat generation line A. Thus, the heat blocks of the respective rows of the heater 900 are provided at the ends in a substrate longitudinal direction, and the heat generation pattern including one heat generating resistor is provided on a sheet feeding reference side from the heat block (in the center along the substrate longitudinal direction in the present example).

FIG. 16B illustrates an enlarged view showing the heat block A1 as a representative of four heat blocks, and a part of the heat generation pattern AP connected to the heat block A1. In the heat block A1, eight rectangular heat generation patterns each having a line length a and a line width b are arranged, and connected in parallel via a heat generation patterns Aa-1 and Ab-1. The heat blocks A2, B1 and B2 also have a similar constitution. The heat generation pattern AP has a pattern width k.

In the heater of FIGS. 16A and 16B, a heat generation paste used in the heat blocks A1, A2, B1 and B2 has a sheet resistance value which is different from that of a heat generation paste used in the heat generation pattern AP. To regulate the heat generation amount per unit length in the heat block A1 and the heat generation pattern AP along the substrate longitudinal direction, the heat generation paste having a sheet resistance value lower than that of the heat block Al is used in the heat generation pattern AP. Thus, the present invention can be applied to a heater having the heat blocks only at both ends of the heat generation line as described in Example 4.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2009-210706, filed on Sep. 11, 2009, and 2009-289722, filed on Dec. 21, 2009 which are hereby incorporated by reference herein in their entirety.

The invention claimed is:

1. A heater comprising:

an elongated substrate having longitudinal and lateral dimensions; and first and second heat generation lines configured to generate heat, the first and second heat generation lines being provided on the substrate along the longitudinal direction thereof, each of the first and second heat generation lines including a plurality of heat blocks which are electrically connected in series, wherein each of the heat blocks includes first and second conductive members provided on the substrate along the longitudinal direction of the substrate and a plurality of heat generating resistors connected in parallel between the first conductive member and the second conductive member, wherein the positions of the heat blocks of the first heat generation line are shifted from those of the heat blocks of the second heat generation line in the longitudinal direction of the substrate so that the end of the heat block in the first heat generation line does not overlap with the end of the heat block in the second heat generation line in the longitudinal direction of the substrate.

2. The heater according to claim 1, wherein the first heat generation line and the second heat generation line are electrically connected in series.

3. The heater according to claim 1, wherein the first heat generation line and the second heat generation line are configured to be independently driven.

4. The heater according to claim 1, wherein the plurality of the heat generating resistors has a rectangular shape, and the adjacent heat generating resistors are arranged so as to partially overlap with each other in the longitudinal direction.

5. An image heating device comprising:

an endless belt;

a heater according to claim 1, wherein the heater comes in contact with an inner surface of the endless belt; and a nip portion forming member which forms a nip portion together with the heater through the endless belt, and configured to heat a recording material while pinching and conveying the recording material having an image at the nip portion.

6. An image heating device comprising:

an endless belt;

a heater according to claim 2, wherein the heater comes in contact with an inner surface of the endless belt; and a nip portion forming member, which forms a nip portion together with the heater through the endless belt, and is configured to heat the recording material while pinching and conveying the recording material having an image at the nip portion.

7. An image heating device comprising:

an endless belt;

a heater according to claim 3, wherein the heater comes in contact with an inner surface of the endless belt; and a nip portion forming member, which forms a nip portion together with the heater through the endless belt, and is configured to heat a recording material while pinching and conveying the recording material having an image at the nip portion.

8. An image heating device comprising:

an endless belt;

a heater according to claim 4, wherein the heater comes in contact with an inner surface of the endless belt; and a nip portion forming member, which forms a nip portion together with the heater through the endless belt, and is configured to heat a recording material while pinching and conveying the recording material having an image at the nip portion.

9. An image forming apparatus comprising:

an image forming part which forms an unfixed image on a recording material; and a fixing part including an endless belt, a heater which comes in contact with the inner surface of the endless belt, and a nip portion forming member which forms a nip portion together with the heater through the endless belt, configured to heat and fix the unfixed image on the recording material while pinching and conveying the recording material having the unfixed image at the nip portion, the heater comprising:

an elongated substrate having longitudinal and lateral dimensions; and a heat generation line configured to generate heat, the heat generation line being provided on the substrate along a longitudinal direction of the substrate, the heat generation line including a plurality of heat blocks which are electrically connected in series, wherein each of the heat blocks includes first and second conductive members provided on the substrate along the longitudinal direction of the substrate and a plurality of heat generating resistors connected in parallel between the first conductive member and the second conductive member, and wherein the plurality of heat generating resistors are arranged so that when the recording material having at least one specific size of sizes smaller than the largest standard recording material size adapted to use in the apparatus passes through the nip portion, the edge of the recording material in the longitudinal direction does not pass through areas provided with the heat generating resistors at both ends of the heat generation line in the longitudinal direction of the substrate.

10. The image forming apparatus according to claim 9, wherein the heater includes a plurality of heat generation lines including the heat blocks disposed in a recording material conveyance direction.

11. The image forming apparatus according to claim 9, further comprising a sheet feeding tray including a pair of recording material regulation plates movable in the longitudinal direction according to the size of the recording material, wherein the plurality of heat generating resistors are arranged so that the side of the recording material opposite to a side thereof which comes in contact with the regulation plate does not pass through the areas provided with the heat generating resistors at both ends of the heat block in the longitudinal direction of the substrate, when the sheet is fed while one side of the recording material having the specific size at the end thereof in the longitudinal direction is brought into contact with one of the regulation plates in a state where a distance between the regulation plates is set to be the longest.

* * * * *